US009850715B2

(12) United States Patent
Beckwith et al.

(10) Patent No.: US 9,850,715 B2
(45) Date of Patent: Dec. 26, 2017

(54) MODULAR COMPACTION BORING MACHINE SYSTEM

(71) Applicant: The Charles Machine Works, Inc., Perry, OK (US)

(72) Inventors: Jerry W. Beckwith, Perry, OK (US); Dustin Blessum, Edmond, OK (US); Michael F. Gard, Perry, OK (US); Tony D. Kukuk, Perry, OK (US); Jason N. MacDonald, Stillwater, OK (US); Monika E. B. Salas, Perry, OK (US); F. Loyd Sands, Perry, OK (US); Wally E. Shaffer, Perry, OK (US); Richard F. Sharp, Perry, OK (US); Brent G. Stephenson, Mulhall, OK (US); Damon C. Webb, Perry, OK (US); Kendall C. Young, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 177 days.

(21) Appl. No.: 14/606,155

(22) Filed: Jan. 27, 2015

(65) Prior Publication Data

US 2015/0211302 A1 Jul. 30, 2015

Related U.S. Application Data

(60) Provisional application No. 61/932,004, filed on Jan. 27, 2014.

(51) Int. Cl.

| | |
|---|---|
| ***E21B 7/26*** | (2006.01) |
| ***E21B 4/18*** | (2006.01) |
| ***E21B 47/024*** | (2006.01) |
| ***E21B 47/12*** | (2012.01) |
| ***E21B 7/04*** | (2006.01) |
| ***E21B 19/081*** | (2006.01) |

(52) U.S. Cl.

CPC ..... *E21B 7/26* (2013.01); *E21B 4/18* (2013.01); *E21B 7/046* (2013.01); *E21B 19/081* (2013.01); *E21B 47/024* (2013.01); *E21B 47/12* (2013.01)

(58) Field of Classification Search

None

See application file for complete search history.

(56) References Cited

U.S. PATENT DOCUMENTS 3,326,008 A * 6/1967 Baran ..... E21B 4/04 175/19

4,905,773 A * 3/1990 Kinnan ..... E21B 4/145 175/19

(Continued)

*Primary Examiner* — Shane Bomar

(74) *Attorney, Agent, or Firm* — Tomlinson McKinstry, P.C.

(57) ABSTRACT

A modular compaction boring device. The boring device comprises a compaction boring head which creates a borehole through a subsurface by operation of a thruster and a rear and forward anchor. Extension of the thruster while the rear anchors are engaged move the boring head forward. Retraction of the thruster while the forward anchors are engaged brings the rear anchors forward for an addition stroke. A steering geometry in the boring head and rotation of the boring head allow steering of the boring device. Steering, thrust, and anchors may be controlled remotely through an umbilical cable pulled through the borehole by the boring device.

45 Claims, 17 Drawing Sheets

(56) References Cited

U.S. PATENT DOCUMENTS

| | | | | |
|---|---|---|---|---|
| 5,695,014 | A * | 12/1997 | Jenne | B25D 9/145 173/63 |
| 7,528,946 | B2 * | 5/2009 | Gunsaulis | E21B 7/046 175/26 |
| 8,196,681 | B2 | 6/2012 | Bick | |
| 8,746,369 | B2 | 6/2014 | Hyde et al. | |
| 2003/0108393 | A1 * | 6/2003 | Coenen et al. | E21B 4/06 405/235 |
| 2011/0067926 | A1 | 3/2011 | Moore | |

* cited by examiner

MODULAR COMPACTION BORING MACHINE SYSTEM

CROSS REFERENCE TO RELATED APPLICATION

This application claims the benefit of U.S. Provisional Patent Application Ser. No. 61/932,004, filed on Jan. 27, 2014, the entire contents of which are incorporated herein by reference.

FIELD

The present invention relates generally to a boring device for creating a borehole by compaction boring.

SUMMARY

In one embodiment, the invention is directed to an apparatus for boring through a subsurface comprising a modular compaction boring device. The modular compaction boring device comprises a boring head to compress the subsurface, a first anchor, a second anchor, and a thrust module. The thrust module comprises a thrust member disposed between the first anchor and the second anchor, and a first section and a second section. The first section is moveable relative to the second section to push the head response to operation of the thrust module.

In another embodiment, the invention is directed to a compaction boring device. The compaction boring device comprises a frame, an extendable anchor, and a boring head. The frame comprises a first end and a second end wherein the first end is reciprocally movable axially relative to the second end. The extendable anchor is supported within the frame and extendable from a first position to a second position. The boring head is connected to the first end of the frame. The first end of the frame is rotatable relative to the second end of the frame to manipulate an orientation of the head.

In another embodiment, the invention is directed to a method for advancing a tool through a subsurface. The method comprises orienting a boring head, extending a first anchor, longitudinally extending the tool, extending a second anchor, retracting the first anchor, and longitudinally retracting the tool.

An apparatus for boring through a subsurface comprising a modular compaction boring device, a controller, an electrical power source, and an umbilical cable. The modular compaction boring device comprises a forward anchor module comprising a plurality of extendable anchor arms, an aft anchor module comprising a plurality of extendable anchor arms, an extendable and retractable thrust module disposed between the forward anchor module and the aft anchor module, and a rotatable boring head disposed proximate the forward anchor module. The controller directs extension of the plurality of extendable anchor arms of the forward anchor module and the aft anchor module, extension and retraction of the thrust module, and rotation of the boring head. The umbilical cable comprises a first end and a second end, wherein the umbilical cable provides power from the electrical power source to the modular compaction boring device.

BACKGROUND

Underground emplacement of tubular and filamentary utility structures is ordinarily accomplished by construction techniques such as open-cut trenching, Horizontal Directional Drilling (HDD), microtunneling, and percussive moles. Open-cut trenching, HDD, and microtunneling all involve removal of material from the surrounding soil matrix.

The absence of spoils, drilling fluids, and minimal mechanical disturbance of surface soil make compaction boring technically and environmentally desirable. Compaction boring may be a preferable option for underground construction in environmentally sensitive areas.

DESCRIPTION

For the sake of greatest clarity, the embodiment disclosed herein is described in terms of orientations and connections relative to the surface entry point and the boring head 100 of the modular compaction boring device 10, as will be introduced below. That portion of an element nearest the surface entry point will usually be described using the words "uphole", "rear", or "aft", whereas the portion of an element nearest the boring head 100, which pierces the soil, will usually be described using the words "downhole", "forward", or "fore". Thus, the assumed orientation is that of an observer standing at the surface entry point and looking through the borehole toward the boring head 100 as it engages the soil. These descriptors are used to provide greatest descriptive clarity of configurations used as disclosed herein. However, the descriptors "downhole", "forward", "fore", "uphole", "rear", and "aft" are not intended as limitations of this invention and should not be interpreted as limitations.

Figure 1:
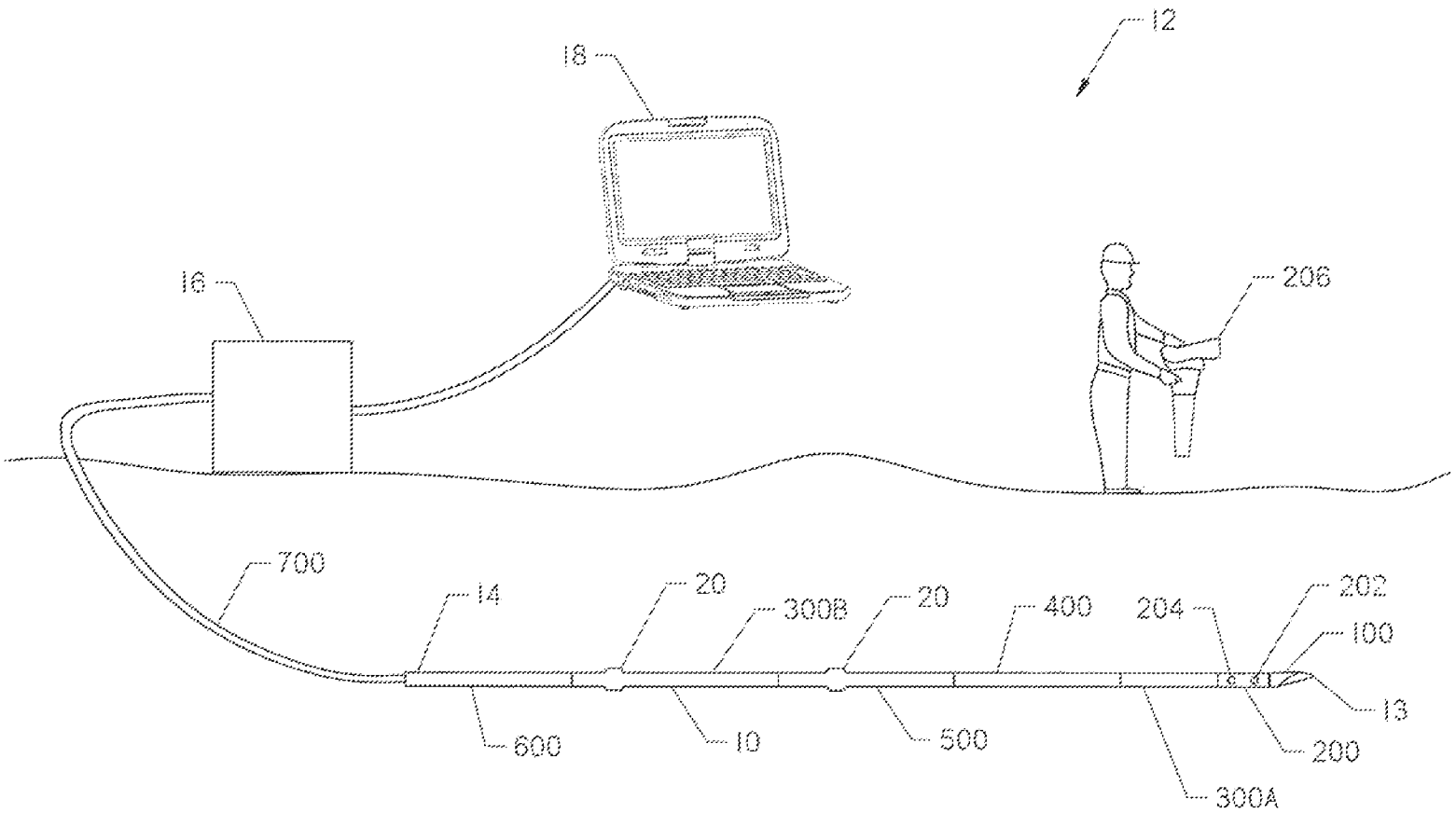
FIG. 1 is a diagrammatic representation of the compaction boring device for use in the present invention.

With reference to the figures in general and FIG. 1 in particular, shown therein is a system 12 for boring through a subsurface 11 in accordance with the present invention. The system 12 comprises a modular compaction boring device 10, an umbilical cable 700, a system controller 18, and an electrical power source 16. The boring device 10 moves through the subsurface 11 to form a borehole. The boring device 10 has a frame which may comprise various modules including a boring head 100, a navigational device 200, at least one anchor module 300A and 300B, a rotation module 400, a thrust module 500 and a slip indicator module 600. The boring head 100 is located at a first, or downhole end 13 of the boring device 10, while the umbilical cable 700 is attached to the device at a second, or uphole end 14 of the boring device 10. As shown in FIG. 1, multiple modules of each of the modular units above may be utilized for optimal performance of the boring device 10 in a particular soil condition or for a particular application. For example, multiple anchor modules 300 provide additional stability for the device 10, while additional rotation modules 400 increase the rotation rate of the boring head 100. Additionally, while the boring device 10 shown herein utilizes the navigational device 200, short, simple bores may be performed without such navigational tools. Therefore, the modular nature of the boring device 10 allows the system 12 to be used in multiple configurations without departing from the spirit of this invention.

The umbilical cable 700 enables power transfer, data communications and other conduits between the surface and subsurface elements. The umbilical cable 700 connects to the second, uphole end 14 of the boring device 10. The umbilical cable 700 may also contain elements that are routed through each module 200, 300, 400, 500, 600 to provide communication, power and fluid connection at each module. The electrical power source 16 may be located at the surface and provides power to the component modules through the umbilical cable 700. The system control element, or system controller 18 monitors and controls the modules 300, 400, 500, 600 using data received from the umbilical 700 and navigational information transmitted from the navigational device 200. The system controller 18 is depicted herein as a computer, but one should appreciate that the controller may comprise a local computer, a remote computer, a handheld device, remote control, or a combination of the above control mechanisms or other known controllers. Controller logic performed by the system controller 18 may be automated in response to signals generated at the boring device 10. Further, while a robust umbilical cable 700 is contemplated for transmission between the system controller 18 and boring device 10 in the borehole, components of the umbilical cable 700 at the surface may be separated and traditional wiring for data communication and electrical conductivity may be used with the system controller 18 and electrical power source 16 without departing from the spirit of the invention.

The anchor modules 300 allow the boring device 10 to be held stationary relative to the subsurface 11. As described herein, two or more anchor modules 300 may be provided. As shown in FIG. 1, a forward anchor module 300A and an aft anchor module 300B are utilized. The anchor modules 300A, 300B work in concert to provide a "hand-over-hand" engagement with the ground to provide reaction points for the device 10 to assist it in moving through the subsurface 11. The rotation module 400 rotates the entire device 10 between the rotation module and the boring head 100. Constant rotation of the boring head 100 keeps the direction of travel of the boring device 10 substantially straight and aids in compaction boring. Limited rotation may be utilized to orient the boring head 100 for steering the boring device 10. The thrust module 500 extends or retracts a distance between the downhole end 13 and the uphole end 14 of the device 10.

In operation, the boring device 10 is advanced by engaging the rear anchor module 300B with the subsurface 11 while the front anchor module 300A is in a retracted position that is not engaged with the subsurface. The thrust module 500 extends, causing the boring head 100 to move forward. The rotation module 400 is optionally active during thrust depending on the desired direction of advancement. After extension of the thrust module 500 a desired distance is achieved, the front anchor module 300A is engaged, the rear anchor module 300B is disengaged, and the thrust module is retracted to pull the second, uphole end 14 of the device 10 forward toward the boring head 100.

The boring device 10 comprises a plurality of surface features 20 which have a slightly larger cross-sectional area than the boring device. One of ordinary skill will appreciate that the boring head 100 may create a borehole with a slightly larger radius than the cross-sectional area of the boring device 10. While this may be advantageous for reducing frictional forces involving the boring device 10, contact between the boring device and subsurface 11 may dissipate heat generated by internal components of the modules 300, 400, 500. Thus, the surface features 20 are provided to establish and generate contact between the boring device 10 and the subsurface 11. Preferably, the surface features 20 are disposed proximate motor elements inside the modules 300, 400, 500, as is shown in more detail with reference to FIGS. 3-5.

Figure 2:
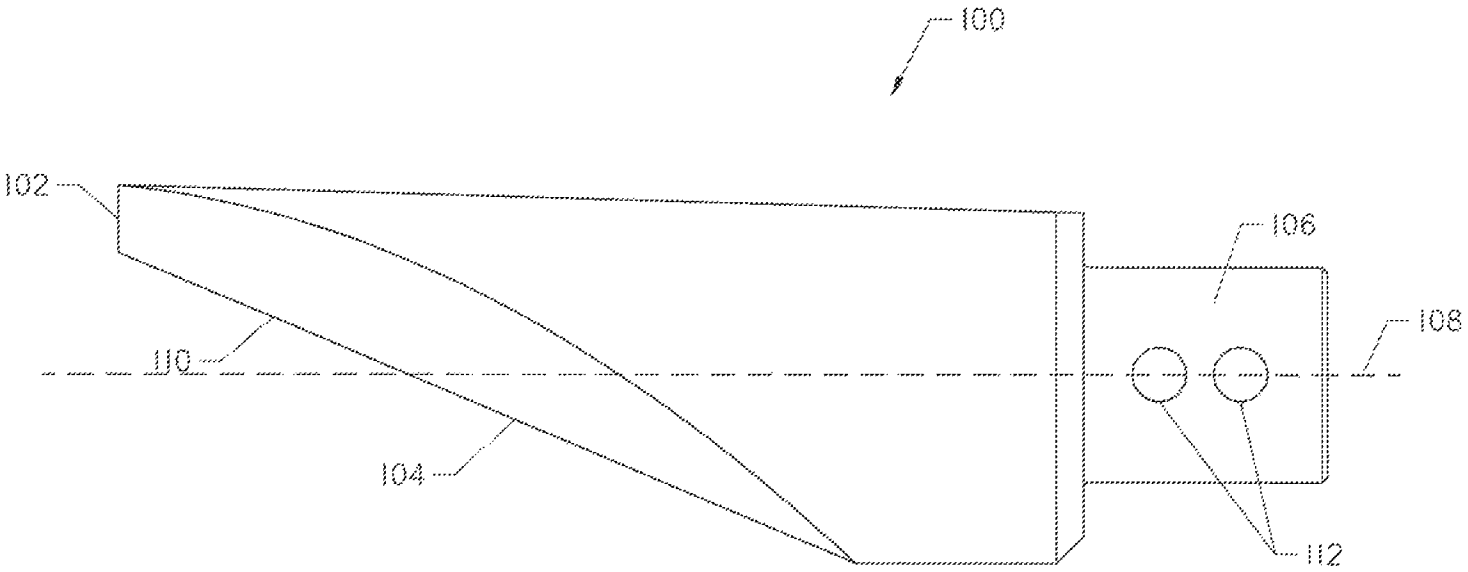
FIG. 2 is a side view of a boring head for use with the boring device of the present invention.

With reference now to FIG. 2, the boring head 100 comprises an asymmetrical modified conic shape, commonly called a slant-faced bit. The boring head 100 comprises a nose 102, a slanted face 104, and a connection point 106. The nose 102 preferably has a small cross-section such that resistance to thrust is reduced. The nose 102 is offset from a centerline 108 of the boring head 100. The slanted face 104 may contain a flat surface feature 110 and contacts the ground such that the boring head 100, when advanced without rotation (or with partial rotation over a desired arc), is deflected away from the centerline 108 in the direction of the nose 102 when advancing and compacting soil. With rotation of the boring head 100, the nose 102 travels in a roughly spiral path about the centerline 108 and proceeds in a substantially straight line. The connection point 106 enables mechanical connection of the boring head 100 with other modules of the device. As shown, the connection point 106 comprises one or more holes 112 for a pinned connection. Other types of mechanical connections such as threaded joints could also be used. The boring head 100 does not require compressed air or hydraulic fluid, thereby avoiding the compressors and pumps that normally accompany HDD operations generally and percussive or hydraulic mole drilling in particular.

With reference again to FIG. 1, the navigational device 200 may comprise a beacon 202 and an orientation sensor 204. Because there is no percussive hammer associated with the compaction boring device 10, the navigational device 200 is not subjected to shock forces associated with such devices. The beacon 202 may be a known device as is commonly found as a part of a HDD downhole tool assembly. Such beacons 202 transmit a dipole electric field which may be received at an above-ground tracking receiver 206. The tracking receiver 206 is then able to determine the position and orientation of the beacon, and therefore the boring head 100, from the measured field, as described in U.S. Pat. No. 7,952,357, issued to Cole, et al. the contents of which are incorporated herein by reference. The orientation sensor 204 is used to determine the bearing of the boring head 100 in three dimensions and generally comprises a pitch sensor to determine the front-to-back (fore-to-aft) pitch of the navigational device and a roll sensor for detecting the roll orientation of the slanted face 104 (FIG. 2) of the boring head 100, often expressed as a position on a clock face. Information detected by the orientation sensor 204 may be transmitted to the system controller 18 through the umbilical cable 700. Further, signals may be sent to the beacon 202 through the umbilical cable 700 to cause the beacon to transmit or cease transmission of a dipole magnetic field, or to adjust the amplitude or frequency of the emitted magnetic field. The above ground tracker 206 communicates the signal received from beacon 202 with the system controller 18 via wireless or wireline communication.

Anchor Module

Figure 3A:
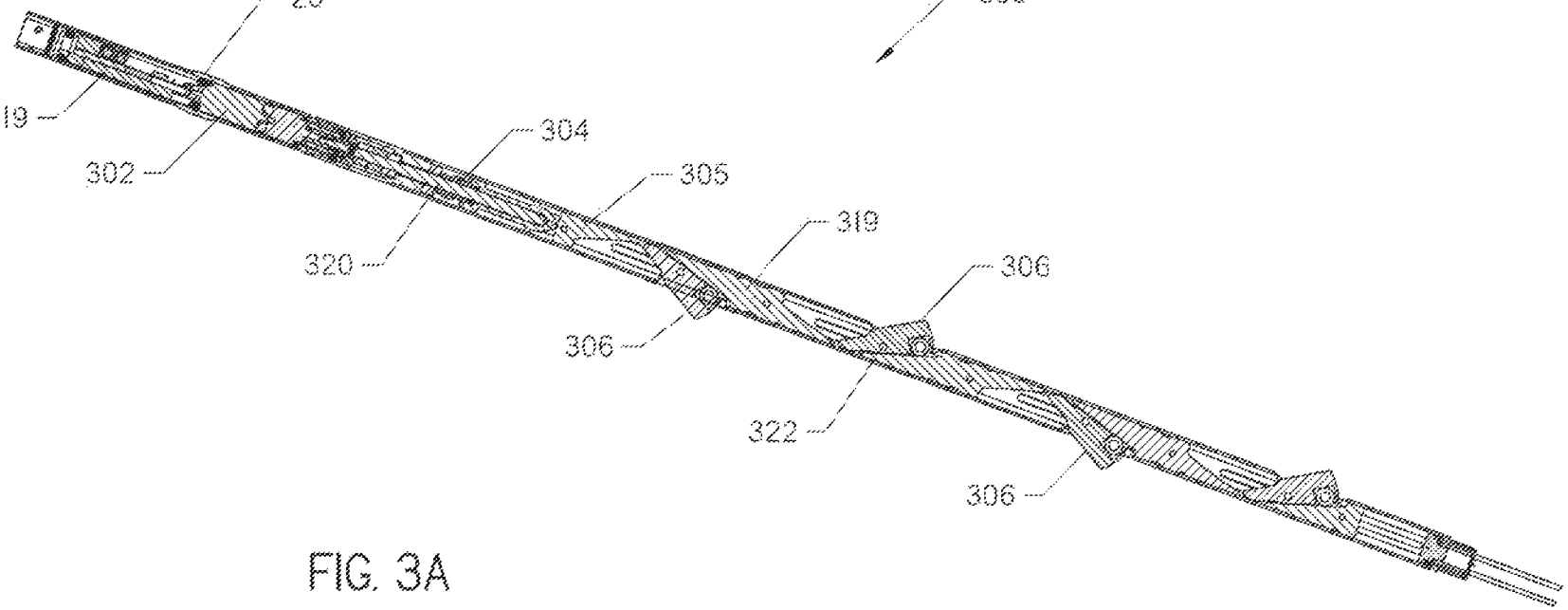
FIG. 3A is a sectional side view of an anchor module for use with the boring device of the present invention.
Figure 3B:
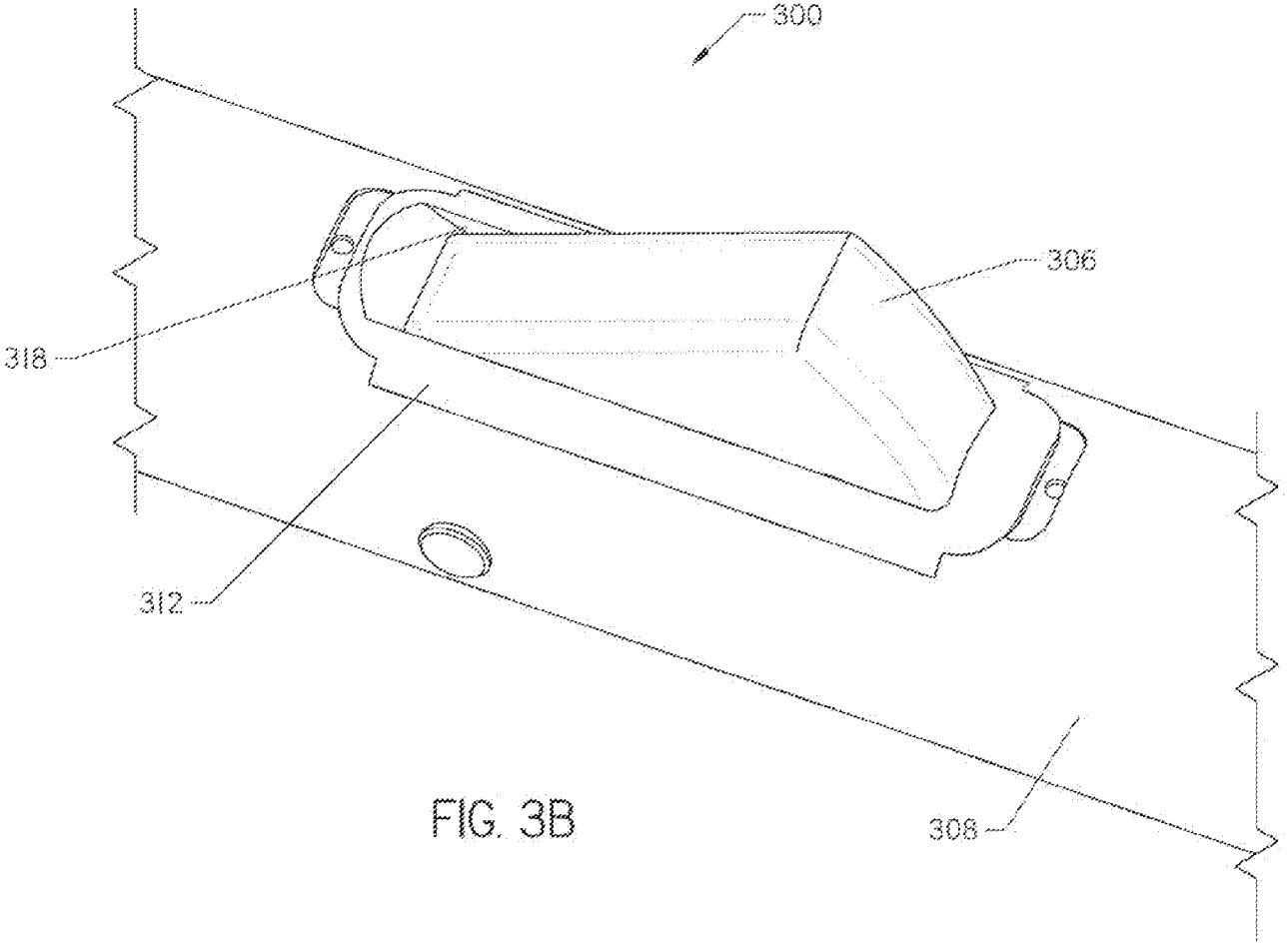
FIG. 3B is a cut-away perspective view of the anchor module of FIG. 3A.

With reference now to FIGS. 3A and 3B, shown therein is an anchor module 300. The anchor module 300 comprises a motor controller 19, an electric anchor motor 302, an anchor actuator 304, linkages 305, multiple anchor arms 306, housing 308, window seals 312, and a ball screw 320. Each module of the boring device 10, including anchor module 300, includes a motor controller 19. The housing 308 comprises multiple windows 318, and otherwise covers internal components of the anchor module 300. In the anchor module 300, the motor controller 19 communicates with system controller 18 (FIG. 1), controls the speed, power and torque of the electric anchor motor 302, monitors internal sensors, provides communication to downhole modules, and may monitor and measure orientation with respect to gravity, internal temperature, motor current, and other data. Motor controller 19 is configurable and may vary in configuration between modules 300, 400, 500.

As shown, the electric motor 302 rotates ball screw 320, causing the anchor actuator 304 to extend the linkages 305. The linkages 305 may comprise wedges 319, as shown, or other advantageous geometries, linked to the anchor actuator 304. The wedges 319 move within the housing 308, causing the arms 306 to pivot about pivot points 322 and extend through windows 318. Thus, as wedges 319 are moved by the anchor actuator 304, the anchors 306 move from a retracted position to an extended position or vice versa. Travel sensors, such as Hall effect sensors (not shown) may be utilized to determine the end-of-travel of wedges 319 such that anchors 306 are not moved beyond operational limitations. Wedges 319 and anchor actuator 304 may be configured so that power is required to maintain the anchors 306 in an extended position, so that in the case of a loss of power downhole, the anchors may retract.

Under direction of the system controller 18 and motor controller 19 and signals sent through the umbilical cable 700 (FIG. 1), the electric motor 302 operates the anchor actuator 304 such that the linkages 305 move anchor arms 306 from a first, closed, position to a second, open, position. The linkages 305 may move all of the anchor arms 306 uniformly, or may adjust the anchor arms differently, depending on the type of linkage used. For example, a linkage 305 may extend each anchor arm 306 from front-to-back or back-to-front, enabling a subset of anchor arms to be extended. Many anchor arm 306 geometries are possible. The arms 306 may be paddles, hooks, or similar structures. Particular subsurface 11 materials, such as sand, gravel, loam or clay may require different anchor arm 306 structures to optimize performance.

In the closed position, the anchor arms 306 are contained entirely within the housing 308. Thus, the anchor module 300 provides minimum friction with the subsurface. In the open position, as shown in FIG. 3A, the anchor arms 306 extend beyond the housing 308 of the of the anchor module through the windows 318. When extended, the arms 306 engage the wall of the borehole, compacting the subsurface 11 engaged by the arms, and remain engaged with the borehole wall until retracted in response to commands issued by the system controller 18. The anchor arms 306 engage and compress the borehole wall, resisting rotational and thrust forces applied by other tool modules to hold the anchor module 300 firmly in place in the borehole.

The arms 306 may be spaced to cause the arms to engage the borehole in substantially the same locations or "footprint" along the borehole wall as the boring device 10 moves through the subsurface 11. When such a configuration is used, the thrust module 500 must be coordinated to allow the creation and maintenance of such "footprints". Repeated use of the same anchor locations helps preserve the integrity of the borehole wall and provides improved compaction in the anchor footprint.

As shown in FIG. 3B, window seals 312 are provided to prevent debris from interfering with proper operation of internal mechanisms associated with anchor actuator 304 and anchor arms 306. Window seals 312 may comprise elastomer seals snugly fit about anchor arms 306. Window seals 312 may also comprise a protective element (not shown) such as thin sheet metal to prevent elastomeric window seals 312 from contacting the subsurface 11 and increasing frictional forces on the boring device 10. A space for window seals 312 and associated protectors may be provided at the perimeter of the windows 318, such that the anchor module maintains a substantially uniform radius, except for surface elements 20. Alternative materials may be used for window seals 312, and the method by which seals and protectors are held in place is not limiting on the present invention.

The anchor module 300 is attached at each end to adjacent modules by a pinned or other mechanical connection. Electrical power, data communication connections, and fluid connections (not shown) are provided through each end of the anchor module 300. Surface feature 20 is provided proximate the motor 302 to promote heat transfer from within the anchor module 300.

Rotation Module

Figure 4:
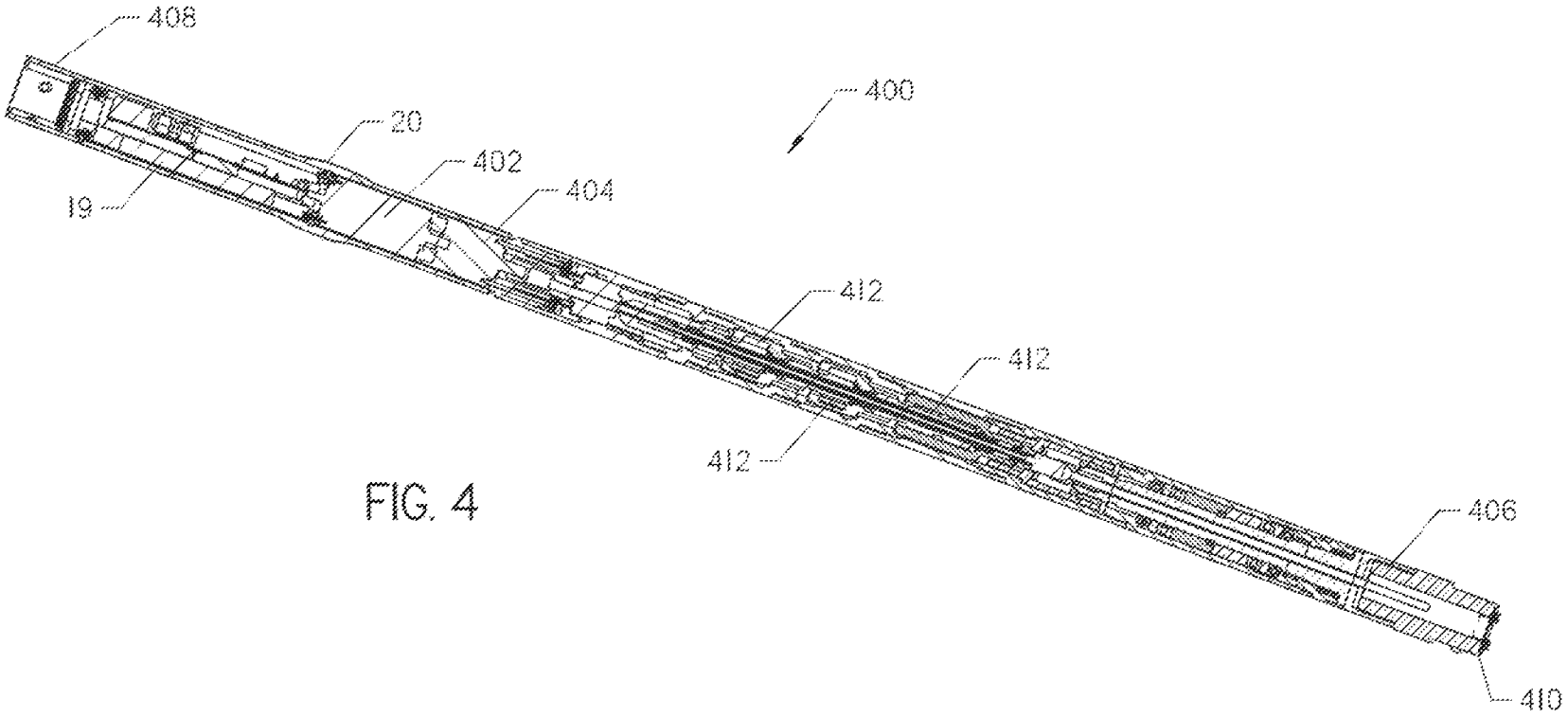
FIG. 4 is a sectional side view of a rotation module for use with the boring device of the present invention.

With reference now to FIG. 4, the rotation module 400 is shown therein. The rotation module 400 comprises a motor controller 19, an electric rotation motor 402, a reducing gearbox 404 and an output shaft 406. The rotation module 400 defines a first, uphole end 408 and a second, downhole end 410. The motor controller 19 communicates with system controller 18, controls the speed, power and torque of the electric rotation motor 402, monitors internal sensors, provides communication to downhole modules, and may monitor and measure orientation with respect to gravity, internal temperature, motor current, and other data.

The rotation motor 402 may be a direct current motor receiving its operating power through the umbilical cable (FIG. 1). The gearbox 404 responds to rotation of the motor 402 and produces torque forces to rotate the output shaft 406 relative to the first end 408 of the rotation module 400. One skilled in the art will understand that the boring head 100 (FIG. 1) is located downhole (forward) of the second end 410. The rotation module 400 is attached to the boring head 100 and downhole modules at its downhole end 410 by a pinned or other mechanical connection. Electrical power, data communication, and fluid connections (not shown) are provided through each end of the rotation module 400. Surface feature 20 is provided proximate the motor 402 to promote heat transfer from within the rotation module 400.

The gearbox 404 is connected to multiple planetary stages 412 for reducing the speed and increasing the torque transmitted to the output shaft 406 by the motor 402. The rotation speed of the downhole end 410 relative to the uphole end 408 is therefore related to the rotation speed of the motor 402 and the number of planetary stages 412 of the gearbox 404. The motor controller 19 communicates with the system controller 18 (FIG. 1) to regulate the rotational output of the motor 402 and therefore the rotational speed provided by the rotation module 400. Multiple rotation modules 400 may be used in the boring device 10 to enable greater rotation rates of the drill head 100. Further, the system controller 18 (FIG. 1) may be utilized to operate different rotation modules 400 at different rotation rates. In addition to continuous rotation, the rotation modules 400 enable "clocking", or orientation of the boring head 100 for steering of the boring device 10 without rotation, accomplished by applying thrust to boring head 100 without rotation.

Additionally, the rotation module 400 may be utilized to cause the boring head 100 to make small limited back-and-forth angular displacements in an operation known as "dithering". These small displacements allow the boring head 100 to steer with less thrust force and reduce the risk of borehole slippage. Thus, the rotation module 400 may be able to reverse rotation direction to enable dithering of the boring head 100.

Thrust Module

Figure 5A:
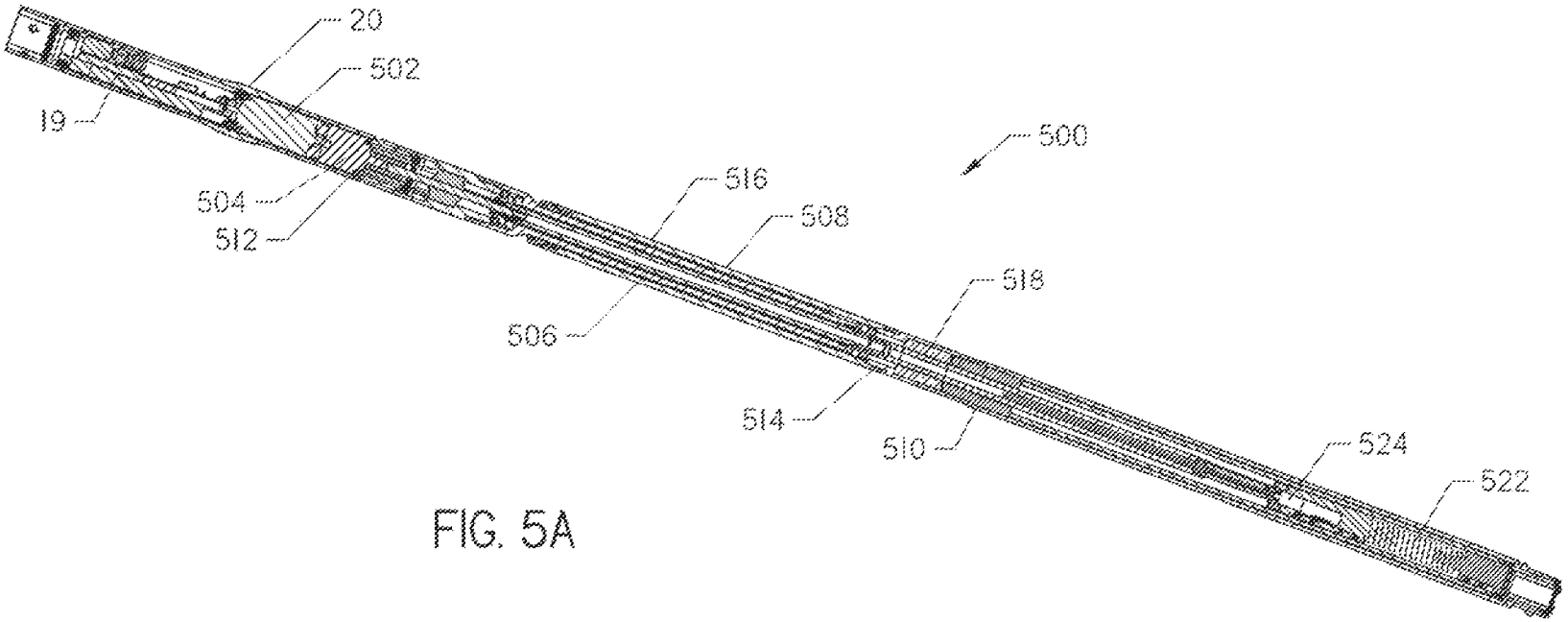
FIG. 5A is a sectional side view of a thrust module for use with the boring device of the present invention.

With reference now to FIG. 5A, the thrust module 500 is shown therein. The thrust module 500 comprises a motor controller 19, a motor 502, a gearbox 504, a thrust rod 506, a barrel 508, and a screw drive 510 comprising a torque tube 516 and a screw nut 518. The motor controller 19 communicates with system controller 18, controls the speed, power and torque of the motor 502, monitors internal sensors, provides communication to downhole modules, and may monitor and measure orientation with respect to gravity, internal temperature, motor current, and other data.

The thrust rod 506, as shown, is attached to the uphole end of the thrust module 500, and nested within the barrel 508 which is attached to the downhole end of the thrust module. The screw drive 510 comprises a first end 512 and a second end 514. The first end 512 is attached to the gearbox 504 via the torque tube 516. The second end 514 is attached to the barrel 508 via the screw nut 518. As shown, the first end 512 is uphole, and the second end 514 is downhole, though reverse orientations may be utilized without departing from the spirit of the invention.

Figure 5B:
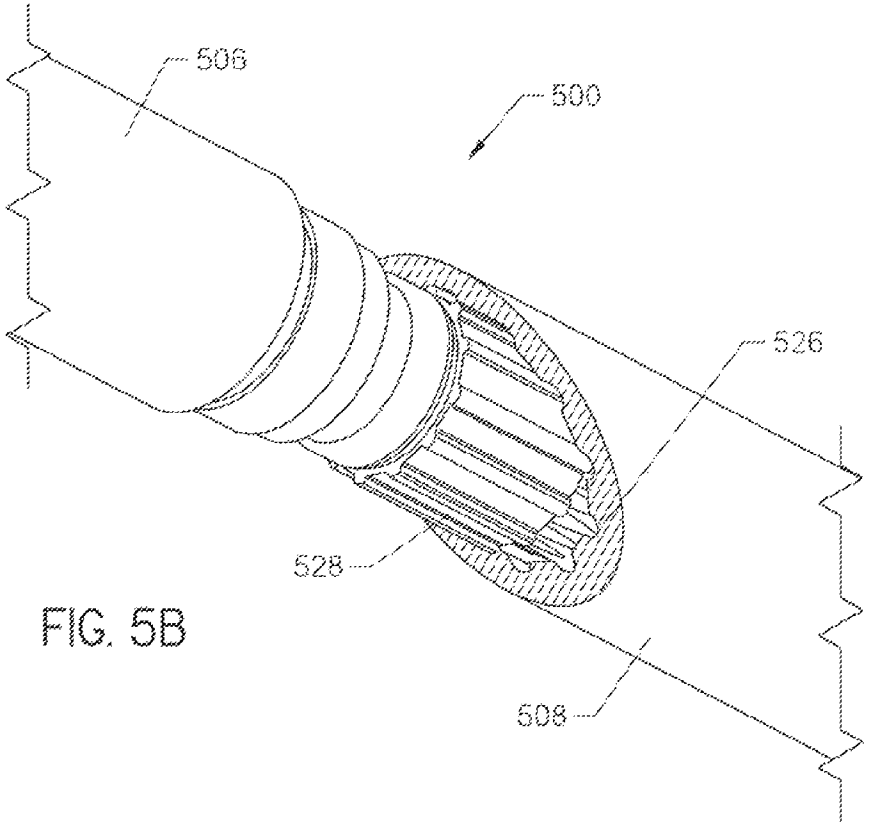
FIG. 5B is a partial cut-away perspective view of the thrust module of FIG. 5A.

The screw drive 510 is operable in an extension and a retraction mode. In extension mode, operation of screw drive 510 increases the distance between the first end 512 and the second end 514, causing the thrust rod 506 to extend from the barrel 508, increasing a length of the thrust module 500. In retraction mode, operation of screw drive 510 decreases the distance between the first end 512 and the second end 514, causing the thrust rod 506 to retract into the barrel 508, decreasing a length of the thrust module 500. As shown in FIG. 5B, the barrel 508 may comprise grooves 526 and the thrust rod 506 may comprise a splined portion 528 such that torque transmission occurs along the length of the thrust module 500 during the entire thrust stroke, to reduce loss of rotational force applied through the thrust module by a rotation module 400 (FIG. 4). One skilled in the art will appreciate that other torque transmission mechanisms enabling constant rotation of the thrust module 500, such as geometric thrust rods and barrels, may be utilized without departing from the spirit of the invention.

Multiple thrust modules 500 can be mounted in tandem to control the thrust rate. In one embodiment, multiple thrust modules mounted in tandem can increase the thrust advance rate. Boring head 100 (FIG. 1) advance may be done with or without rotation, so the thrust module 500 may support full machine torque while extending or retracting. With reference again to FIG. 5A, the thrust module 500 further comprises a cable coil 522. A person skilled in the art will understand that the internal wiring traveling through the thrust module 500 may be constructed to withstand the change in length associated with operation of the screw drive 510. Therefore, the cable coil 522 provides slack for internal electrical wiring in communication with the umbilical cable 700 when the thrust module is retracted. When extended, the cable coil 522 is stretched such that longitudinal force associated with extension of the thrust module 500 is not applied to the internal wiring. Electrical power, data communication, and fluid connections (not shown) are provided through each end of the thrust module 500. Surface feature 20 may be provided proximate the motor 502 to promote heat transfer from within the thrust module 500.

The thrust module further comprises an end of stroke sensor 524. The sensor 524 may comprise a Hall effect sensor or other sensing device that detects the approach of a magnet located on the barrel 508 to indicate the approaching end of thrust stroke to the motor controller 19. Alternatively, limit switches, magnetic position sensors, optical sensors, or their functional equivalents (not shown) may establish minimum and maximum displacement of the screw drive 510.

Slip Indicator

Figure 6:
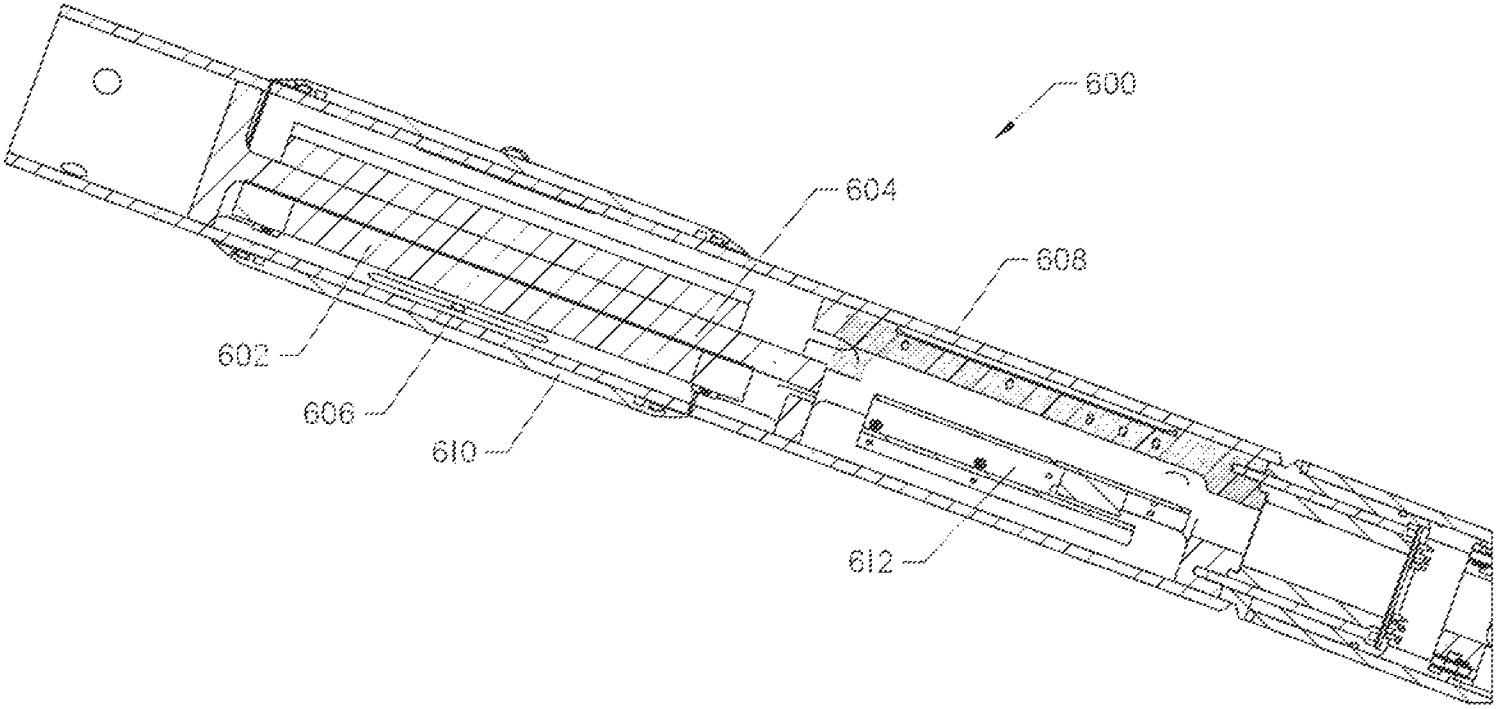
FIG. 6 is a sectional side view of a slip indicator for use with the boring device of the present invention.

With reference now to FIG. 6, shown therein is the slip indicator 600. The slip indicator comprises a slip sensor 602, a sensor mount 604, a magnet 606, a housing 608, a sleeve 610 and a slip controller 612. The slip sensor 602 may comprise a magnetostrictive Linear Displacement Transducer (LDT) mounted on the sensor mount 604 inside the slip indicator housing 608. The magnet 606 is mounted on the sleeve 610 placed about the housing 608 proximate the slip sensor 602. The sleeve 610 engages the borehole wall and is slidable relative to the housing 608. While the sleeve 610 has a circular cross-section in FIG. 6, other geometries are possible within the spirit of this invention.

If there is relative motion between the sensor 602 and the magnet 606, a condition characteristic of tool slippage or relative movement in the borehole is indicated, and the slip sensor output sends a signal to the system controller 18 (FIG. 1) from the slip controller 612. Indication of slip may suggest that forces required to advance the boring device 10 in the subsurface 11 are greater than the holding capacity of anchor modules 300. Actions such as dithering, slowing thrust, or rotating the anchors 306 to engage fresh subsurface 11 may be required.

Umbilical Cable

Figure 7:
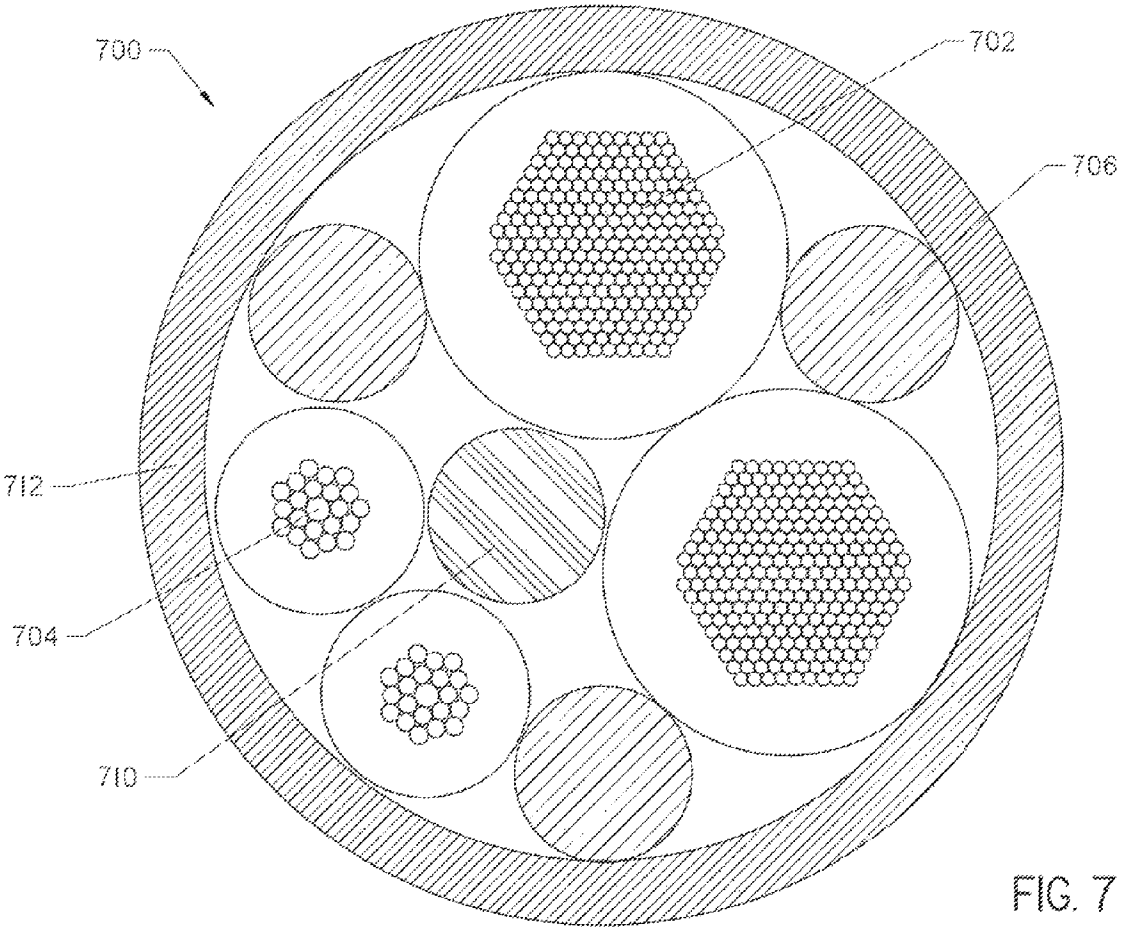
FIG. 7 is a cross-sectional end view of an umbilical cable for use with the boring device of the present invention.

The umbilical cable 700 provides electrical power for the various modules and instrument assemblies in the borehole. It also provides the data path between the system controller 18 (FIG. 1) and the modules 300, 400, 500, 600 and navigational devices 200 in the borehole. With reference now to FIG. 7, a cross-section of one embodiment of the umbilical cable 700 is shown. The umbilical comprises an electric conductor 702, a data conductor 704, and strength members 706. An optical fiber 710 may also be used for high-speed data communication. The umbilical cable 700 may also include a small fluid conduit (not shown) for transmission of fluid, whether liquid or gas. The electric conductors 702 carry electrical power and may comprise copper or other conductive material. Data conductors 704 may comprise a twisted pair of copper (or other conductive material) conductors, miniature coax, optical fiber, or a combination thereof.

As shown in FIG. 7, one or more strength members 706 support tension forces needed to pull the umbilical cable 700 behind the device 10 (FIG. 1) while drilling or when the umbilical cable is retrieved while pulling conduit, cable, pipe, other product or even recovering the compaction boring machine 10 itself through the borehole at the end of drilling operations. The strength members 706 may comprise aramid fiber or other lightweight, high tensile-strength materials. Strength members 706 may fill the interior of a cable jacket 712 not otherwise occupied by electrical conductors 702 and data conductors 704.

FIG. 7 is representative of a general construction of umbilical cable 700. However, alternative embodiments may be utilized, for example, utilizing more than one optical fiber 710 depending on data requirements. Such modifications do not depart from the spirit of the invention. The cable jacket 712 may be fabricated from a material selected to reduce friction between the umbilical cable 700 and the borehole, and may be water resistant.

Cable Reel Handling and Cable Connectors

The umbilical cable 700 may be spooled on a cable reel (not shown) to prevent knotting, fouling, and cable damage. The boring device 10 described may be utilized to create long bores and the umbilical cable 700 length may be thousands of feet. Consequently, a cable handling device (not shown) comprises a support structure for the umbilical cable 700 and the cable reel. The support structure may provide controlled cable 700 payout during drilling, motorized umbilical cable 700 take-up during tool retrieval or product pullback, and it may provide reaction force during retrieval or pullback. The cable handling device may be engineered such that it may retrieve the boring device 10 from the borehole with the anchor module 300 having arms 306 extended in the open position (FIG. 3).

On very long bores, it may be necessary to use more than one reel of umbilical cable 700. Therefore, an umbilical connector (not shown) is provided to connect one length of umbilical cable 700 to a second length. The umbilical connector must therefore be able to withstand pullback loads that are common to the umbilical cable 700 itself then the connector joins the two different umbilical cable segments together.

Electrical Power Source

With reference again to FIG. 1, the electrical power source 16 is described in more detail. The electrical power source 16 may comprise an electrical and electronic assembly. The electrical power source 16 may also comprise electrical and electronic assemblies providing operating power and data communication between the system controller 18, cable reel (not shown) and its controller. FIG. 1 represents the electrical power source 16 as a single object comprising a collection of different functional elements, but those skilled in the art will recognize that various functions may be subdivided between separate units without departing from the spirit of the invention.

The amount of operating power is depends primarily on the number, type, and operating sequence of the machine modules 200, 300, 400, 500, 600 in the borehole. More modules may require more electrical power, for example. The device may employ DC motors in the machine modules 300, 400, 500. The compaction boring machine 10 utilizing a DC power supply minimizes the coupling of AC power line noise on power and data conductors and makes it possible to minimize peak dielectric stress on cable insulation. The use of DC motors and DC power is a design choice, as AC motors could be substituted in each of the modules 300, 400, 500 to provide operating forces. The umbilical cable 700 may include fiber optic cable for data transmission to avoid AC power line noise corruption of the data stream.

Voltage amplitude and total power to be supplied by the electrical power source 16 are determined by the total load and the total resistance of the umbilical cable 700.

Optional Attachments

This disclosure should be understood to provide for attachment of equipment needed to enlarge the borehole. For example, after creating the initial borehole in the subsurface 11, the boring device 10 may be attached to a backreamer (not shown), which is powered by connection to the umbilical cable 700. Alternatively, the boring device 10 may be removed from the umbilical cable 700 at the second, or uphole end 14 of the boring device 10, and a backreamer or similar device added directly to the umbilical cable. The umbilical cable 700 is then pulled back by the cable reel assembly and electrically powered by the umbilical cable, enlarging the borehole as the umbilical cable is pulled from the borehole and respooled on the cable reel (not shown). The backreamer (not shown) may contain a product attachment clevis for use during pullback. Backreamer pullback is known in the art. One backreamer of a type that may be used is shown in U.S. Pat. No. 5,390,750. The backreamer may also be an extendable part of the boring head 100 extended during pullback of the boring device 10.

Machine Control

With continued reference to FIG. 1, machine control is provided at the system controller 18. The system controller 18 may be a personal computer or other such device capable of machine control, operational sequencing of the various modules 300, 400, 500, data communication with the navigational device 200 and slip indicator 600, navigation and machine performance calculations, planning, and functional display of boring device 10 status. Data connections of the umbilical cable 700 are connected either directly or indirectly to the system controller 18. Sliprings, optically or galvanically isolated functional elements, data routers, and similar devices may be used as needed by the particular data communication technology in use at the jobsite. Many data path options are known in the art, and the particular technology employed will depend on jobsite circumstances and umbilical cable 700 construction.

System controller 18 allows for automated control of module 300, 400, 500 functions. One such automatic sequencing is dithering of the boring head 100. Dither steering coordinates thrust and rotation by use of small controlled angular rotation displacements of the rotation module 400, directional reversal of the rotation module motor 402, and thrust of the thrust module 500 in an established sequence. First, rotation of rotation module 400 and thrust module 500 are stopped. Thrust then simultaneously begins with rotation in a first direction. Upon reaching a predetermined terminal angular displacement of the boring head 100, thrust is momentarily discontinued and rotation direction is reversed. Thrust is resumed as opposite rotation begins to another predetermined angular displacement of the boring head 100 and the operation repeats. Similar basic operations are amenable to automation, and such automation is a specific objective of the compaction boring device 10 and its system controller 18

Compaction Machine Operating Sequence

Figure 8:
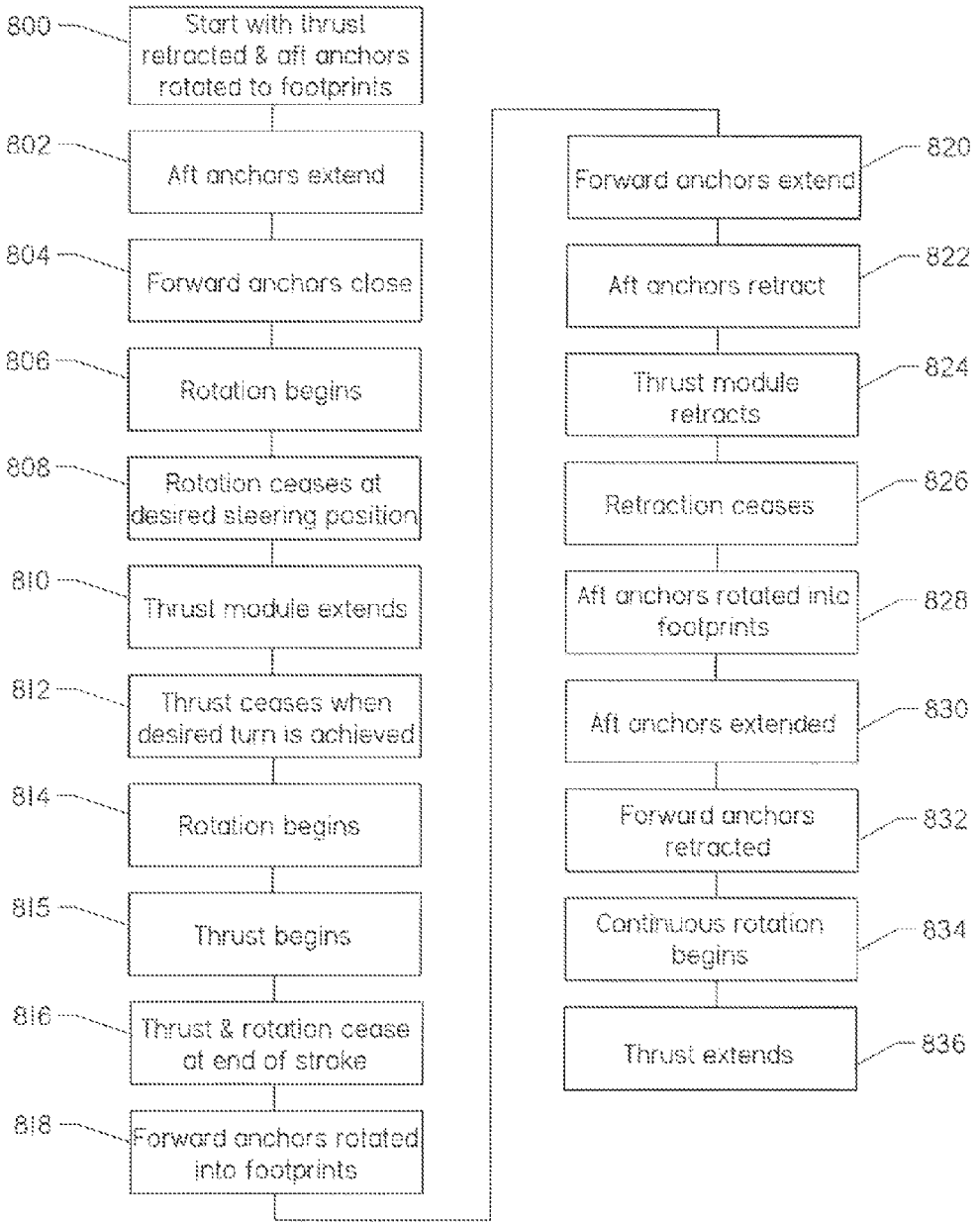
FIG. 8 is a flow chart illustrating a boring method for use with the boring device of the present invention.

With reference now to FIG. 8, an exemplary method for the ordinary operation of the compaction boring device 10 of FIG. 1 is shown therein. For simplicity, the configuration of the boring tool 10 includes only the boring head 100, navigational device 200, forward anchor module 300A, rotation module 400, thrust module 500, aft anchor module 300B and slip indicator 600 shown in FIG. 1. The process of FIG. 8 is a steering push followed by a non-steering push.

The system begins at step 800 with thrust module 500 retracted and aft anchor module 300B properly aligned to an existing footprint of anchor arms 306 in the subsurface 11. The aft anchor module 300B extends its anchor arms 306 to the open position at step 802 and the forward anchor module 300A is in the closed position at step 804. The rotation module 400 begins rotation at 806. When the boring head 100 is at a desired steering position, rotation ceases at step 808. The thrust module 500 extends at step 810. The thrust forces the boring head 100 forward. Thrust is continued until a desired amount of "turn" due to the steering position of the boring head is achieved, then thrust ceases at step 812. The rotation module 400 activates at step 814 and the thrust module 500 begins extending at step 815. The rotation module 400 and thrust module 500 halt when the end of thrust stroke is reached at step 816.

The forward anchor section 300A is rotated by rotation module 400 until the anchor footprint is aligned at step 818. The anchor arms 306 (FIG. 3) of forward anchor module 300A extend at step 820. The anchor arms 306 (FIG. 3) of aft anchor module 300B retract at step 822. The compaction boring machine 10 is then advanced by fully retracting thrust module 500 at 824. Retraction of the thrust module 500 ceases at step 826. The aft anchor module 300B is then aligned by rotation of the rotation module 400 to bring the anchor arms 306 of aft anchor module into alignment with existing footprints of anchor arms in the subsurface 11 at step 828.

Assuming straight boring is desired in the next "stroke", the aft anchor module 300B is extended at step 830, the forward anchor module 300A is retracted at step 832. Continuous rotation of the rotation module 400 begins at step 834 and extension of the thrust module 500 begins again at step 836. The process repeats with either the directional or straight steps as the boring head 100 is advanced along a bore path.

Basic operations of each module 300, 400, 500 may be coordinated to produce a borehole. No spoils are generated as the compaction boring device 10 moves through the subsurface, no drilling fluid is required, and the umbilical cable 700 is dragged through the borehole behind the compaction boring device 10 as the thrust module 500 retracts.

Flexibility of Configuration

The above operating sequences illustrate the basics of compaction boring device 10 operation with a minimum number of modules. In practice, the compaction machine may contain additional modules to provide functional redundancies to preserve the borehole, to improve operational flexibility, to improve boring speed, to increase rotation rate and to prevent operational difficulties. For example, the compaction boring machine may comprise one boring head 100, two forward anchors 300A, two rotation modules 400, one thrust module 500, three aft anchors 300B, an umbilical cable 700, an electrical power source 18, and a laptop computer as the system controller 18. Multiple slip indicators 600 may be utilized for detection of slip in the reverse direction. Multiple navigation devices 200 can allow for sensing of the first end 13 and second end 14 of the boring device 10. The makeup of a particular boring device 10 for use with the system 12 of this invention will vary greatly depending on its needed characteristics for a particular boring operation.

Launch and Retrieval Frame

Figure 9:
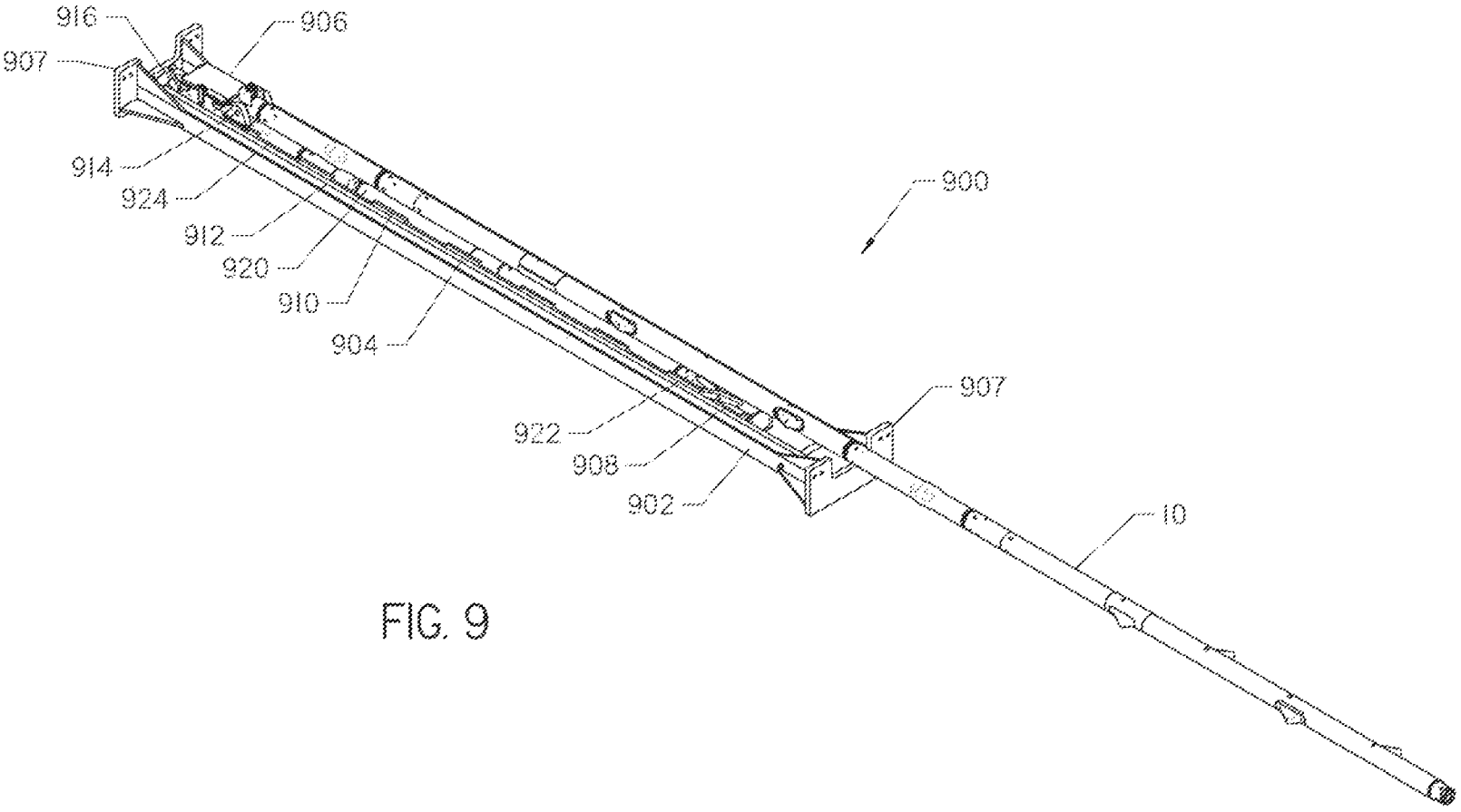
FIG. 9 is a perspective view of a launch frame for use with the boring device of the present invention.

With reference now to FIG. 9, shown therein is a launch and retrieval platform 900 for use with the system 12 to launch the boring device 10 and to retrieve the boring device from the ground. The platform 900 comprises an external frame 902, an internal frame 904, and a carriage 906. The external frame 902 is attached to machine anchors (not shown) and secured to the ground at an above-ground location when launching from the surface. When launching from an excavated pit, the external frame 902 is braced against the pit wall in the front and back at braces 907. The internal frame 904 comprises a connection point 908 and parallel rails 910 with a plurality of castellations 912. The carriage 906 comprises a module connection point 914, a ratchet pawl 916 and guide rollers 926 (FIG. 10).

The internal frame 904 is movable relative to the external frame 902, or may be pinned to the internal frame 904 at the connection point 908. The carriage 906 is moveable along the rails 910 of the internal frame. The ratchet pawl 916 is such that when the internal frame 904 moves in a first direction, such as away from a borehole, the carriage 906 will move over the rails 910 and castellations 912 of the internal frame. When the internal frame 904 is pushed in a second direction, such as when it is forced toward a borehole, the ratchet pawl 916 will engage with the castellations 912 and transmit thrust to the carriage 906.

The platform 900 is operable in a first mode and a second mode. FIG. 9 shows the launch platform in the first mode. In the first mode, a pilot thrust module 920 is placed within the internal frame 904, and is attached at a first end 922 to the connection point 908 of the internal frame and at a second end 924 to the external frame 902. As shown, the first end 922 is proximate a borehole entry point while the second end 924 is distal from a borehole entry point. The pilot thrust module 920 provides relative movement between the internal frame 904 and the external frame 902 to supply thrust forces to the carriage 906. The pilot thrust module 920 may be identical to thrust module 500 described above.

In the first mode, the carriage 906 is attached its module connection point 914 to the modular compaction boring device 10. As shown, the modular compaction boring device 10 comprises two anchor modules 300, though any modules 300, 400, 500 may be present in the first mode. The module connection point 914 may comprise a pinned connection for transmitting thrust from the carriage 906 to the boring device 10. The module connection point 914 may also connect to launch adaptor 925 as will be described with reference to FIG. 10 below, to enable electrical connections between the boring device 10 and electrical power source 16 (FIG. 1).

The launch frame 900 may be used both on a surface of the ground or in an excavated pit. When utilized on a surface of the ground, the distal end of the external frame 902 relative to the entry point in the ground will be elevated. The external frame 902 may utilize legs (not shown) so that the boring device 10 is put together at an angle relative to the ground. In a pit or against a wall, the entry point of the device 10 may be at a desired depth such that legs are not necessary and the boring device will enter the ground with an attitude equivalent to the bottom of the pit or surface of the ground adjacent the wall.

Figure 10A:
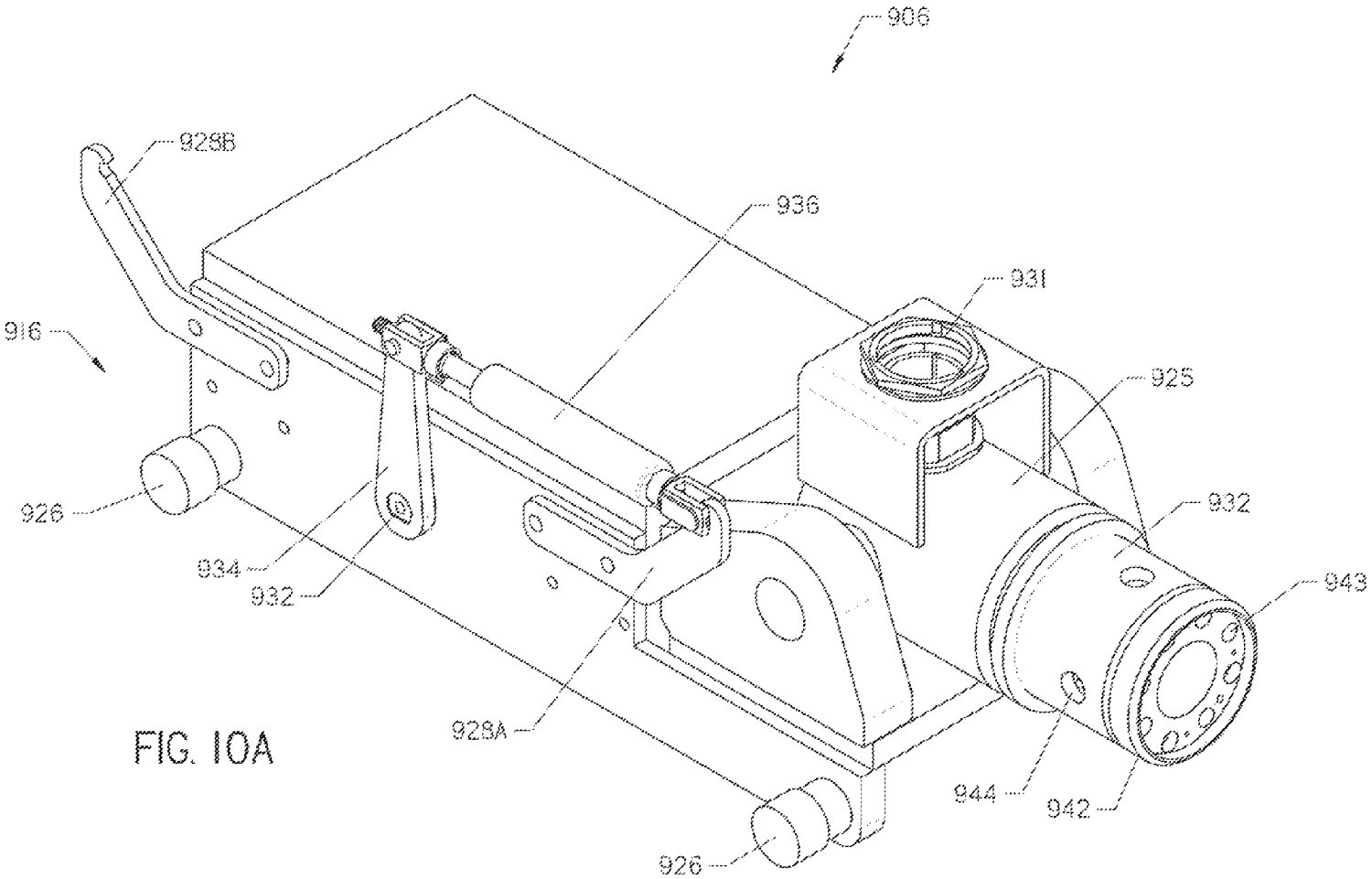
FIG. 10A is a perspective view of the carriage for use with the launch frame of FIG. 9.
Figure 10B:
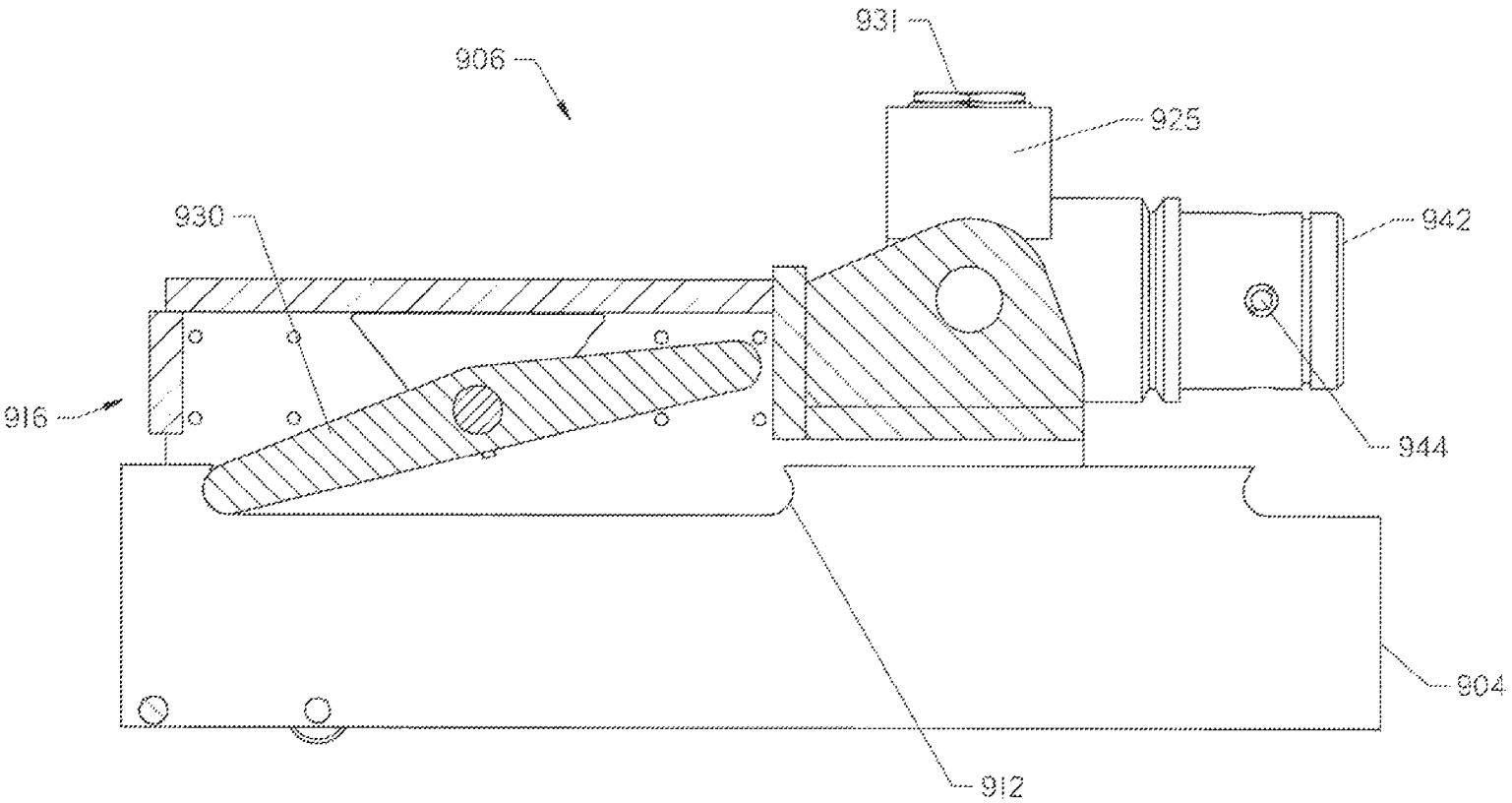
FIG. 10 B is a cross-sectional side view of the carriage of FIG. 10A.

The carriage 906 is shown in more detail in FIGS. 10A and 10B. The carriage 906 further comprises a launch adapter 925, and a plurality of guide rollers 926. The launch adapter 925 provides electrical, fluid and data communication to the boring tool 10 while the launch process is underway. The launch adapter 925 comprises a uphole connection 931 for connection to the electrical power source 16 (FIG. 1) and a boring module interface 942 for providing the same connection to modules 300, 400, 500. The launch adaptor 925 also supplies thrust and torque between the carriage 906 and boring tool 10. The boring module interface 942 comprises a number of terminals 943 for data communication, electrical conductivity, fluid flow, etc. from the umbilical cable to an attached module. The boring module interface 942 further comprises a make-up connection point 944 for transmitting thrust between the carriage 906 and an attached module. As shown in FIG. 10A, the make-up connection point 944 is located on a sidewall of the boring module interface 942 to avoid thrust transmission through sensitive terminals 943. The guide rollers 926 allow the carriage to move along the rails 910 of internal frame 904.

The ratchet pawl assembly 916 comprises ratchet pawls 930, a ratchet pawl spring 936, a pawl drive lever 934 and a pawl drive pin 932. The ratchet pawl assembly 916 shown in FIG. 10 provides two direction levers (downhole direction lever 928*a* and uphole direction lever 928*b*), though one may be utilized when locking engagement of the carriage 906 is desired in only one direction. The ratchet pawl spring 936 may be attached to the downhole direction lever 928*a* and to the pawl drive lever 934 when downhole ratcheting movement is desired. As shown specifically in FIG. 10B, the ratchet pawl spring 936 (FIG. 10A) turns the ratchet pawl 930 such that it engages castellations 912 of the internal frame 904 in the desired direction. However, alternative configurations may be utilized without departing from the spirit of the ratchet pawl assembly 916. When ratcheting movement of the carriage 906 is desired in the opposite direction, the pawl spring 936 is moved such that it attaches to the uphole direction lever bracket 928*b*. Such attachment turns the ratchet pawl 930 such that it engages the castellations 912 of the internal frame 904 in the opposite direction.

Figure 11:
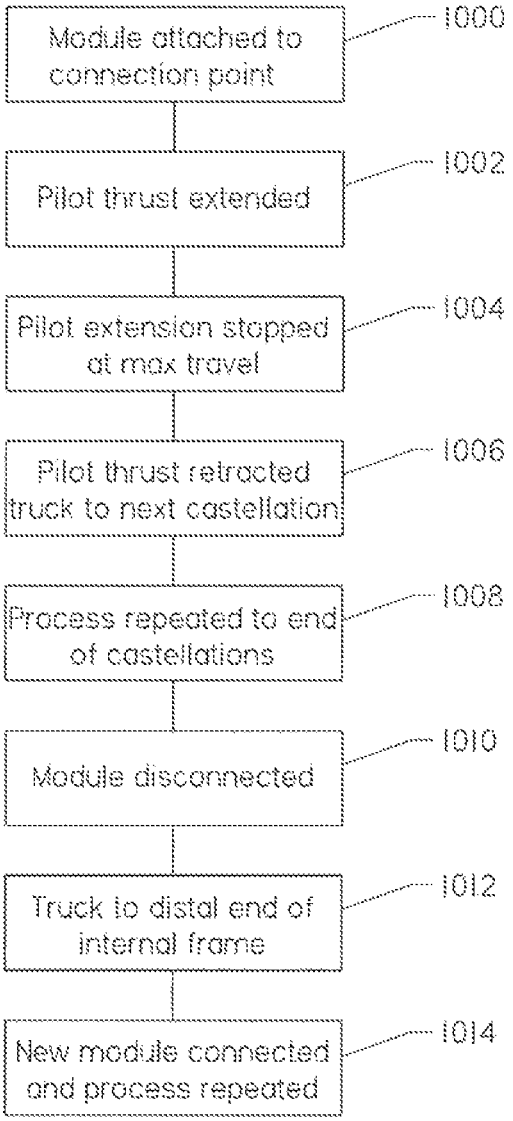
FIG. 11 is a flow chart illustrating a launch method for the boring device of the present invention.

In operation, the launch platform 900 operates in the first mode as shown in FIG. 11. The boring device 10 or a component module thereof is attached to the module connection point 914 at step 1000 with the carriage 906 at a distal end of the internal frame 904. The pilot thrust module 920 is extended at step 1002, causing the internal frame 904 to move toward the borehole, transmitting thrust through castellations 912 to the carriage 906 and pushing the boring device 10 into the ground. Full rotation may be optionally provided at step 1002 if generally straight travel is desired, while dithering or no rotation is utilized if steering is desired. At a desired length of travel, extension of the pilot thrust module 920 is stopped at step 1004. The pilot thrust module 920 is retracted at step 1006, pushing the internal frame 904 away from the borehole, allowing the carriage 906 to travel over the rails 910 to an adjacent set of castellations 912. Extension of the thrust module 920 is resumed and the process is repeated at step 1008 until the carriage 906 reaches the last set of castellations 912. The boring device 10 is then disconnected from the launch adaptor 925 at step 1010, the carriage 906 is moved to a distal end of the internal frame 904 at step 1012, and a new module 300, 400, 500 is attached to the boring device 10 at step 1014. The entire process is then repeated to continue launching the boring device 10.

Figure 12A:
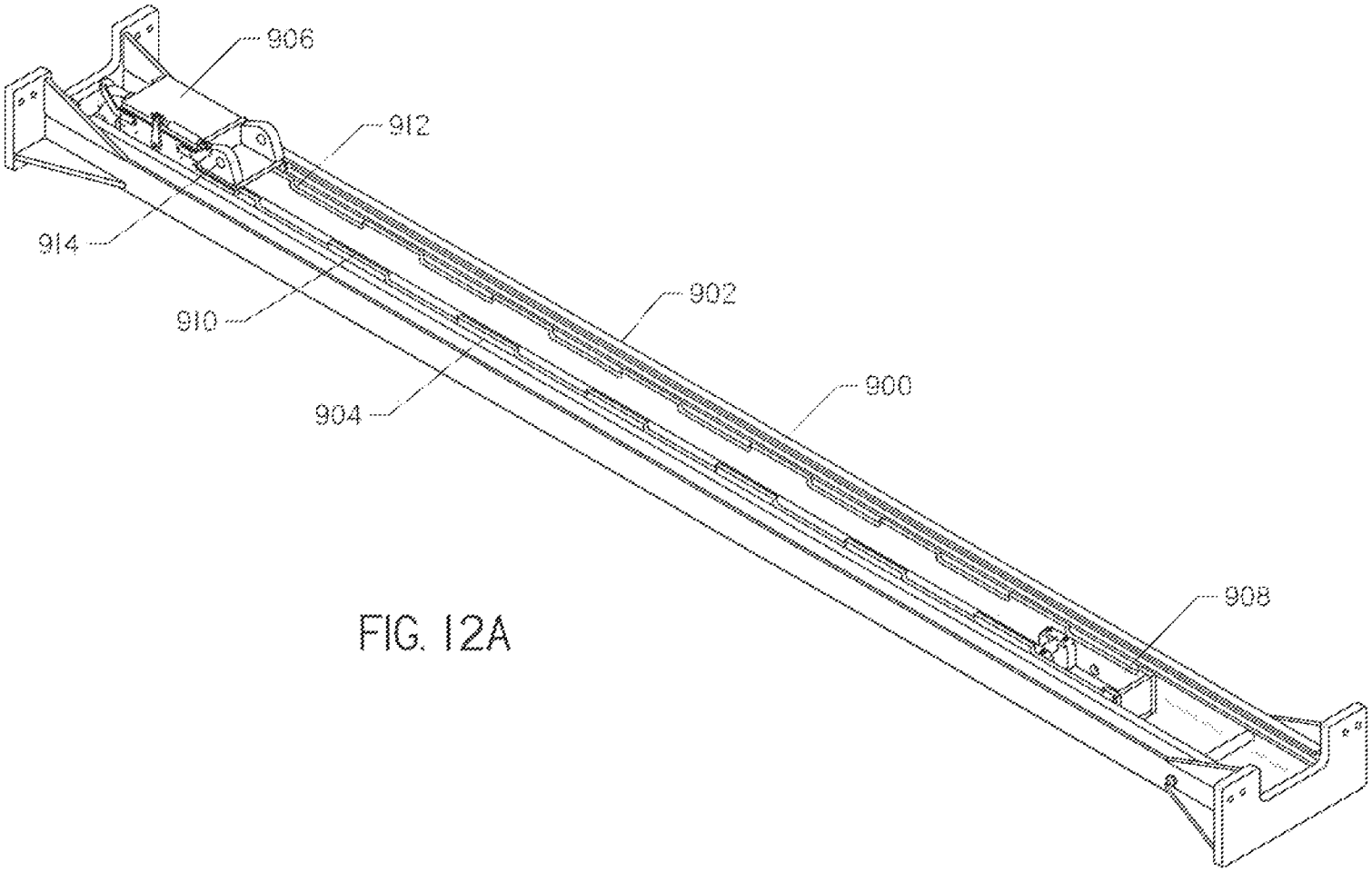
FIG. 12A is a perspective view of the launch frame of FIG. 9 with the boring device removed for clarity.
Figure 12B:
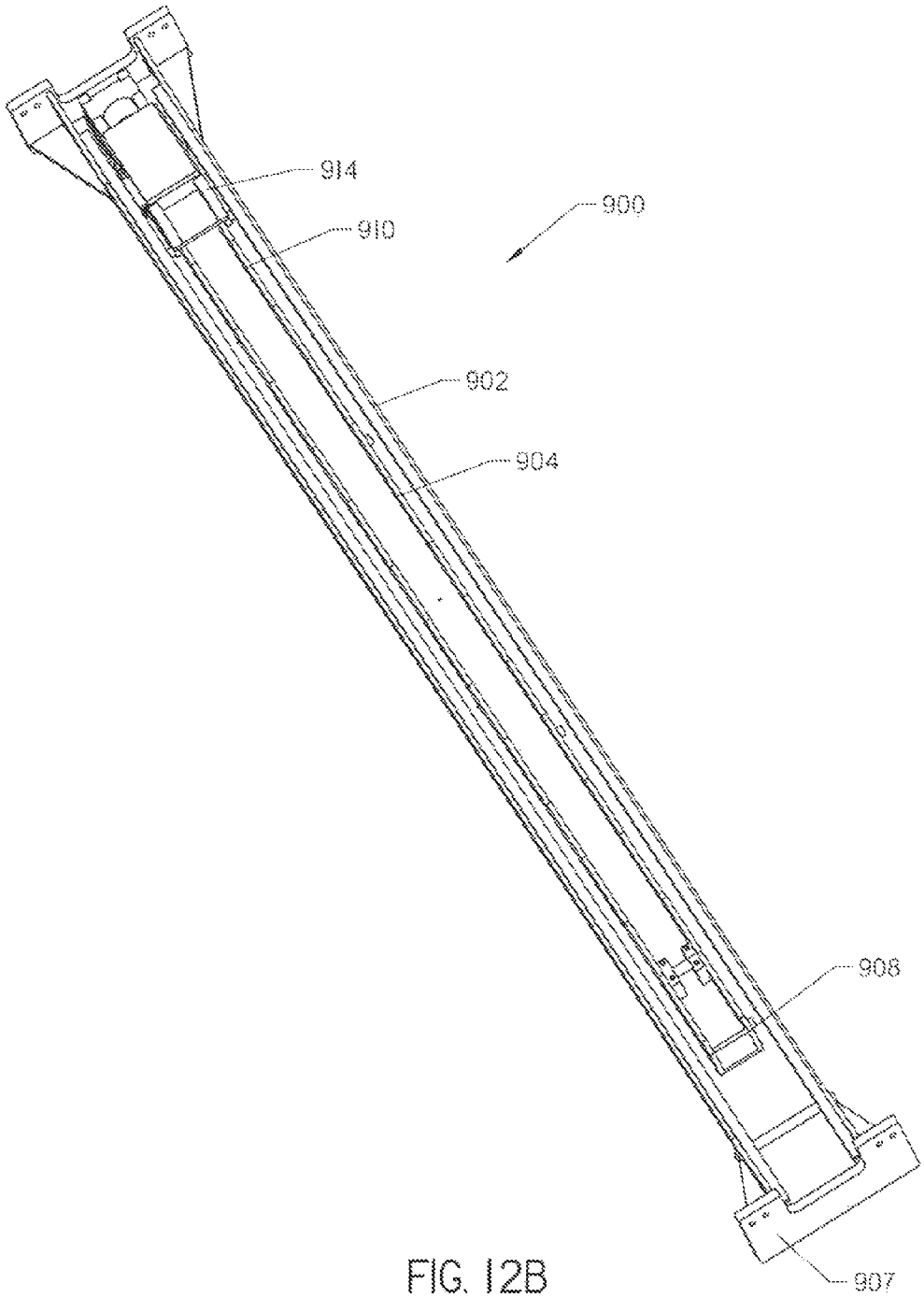
FIG. 12B is a top view of the launch frame of FIG. 12A.

With reference now to FIGS. 12A and 12B, the launch platform 900 is shown without pilot thrust module 920 (FIG. 9). When pilot thrust module 920 is not present, the launch platform 900 is in the second mode. In the second mode, the internal frame 904 is pinned to external frame 902 at its connection point 908 and therefore the internal frame does not move relative to the external frame. In the second mode, advancement of the boring device 10 (FIG. 9) is caused by extension of a thrust module 500 (FIG. 1) attached as a part of the boring device.

Figure 13:
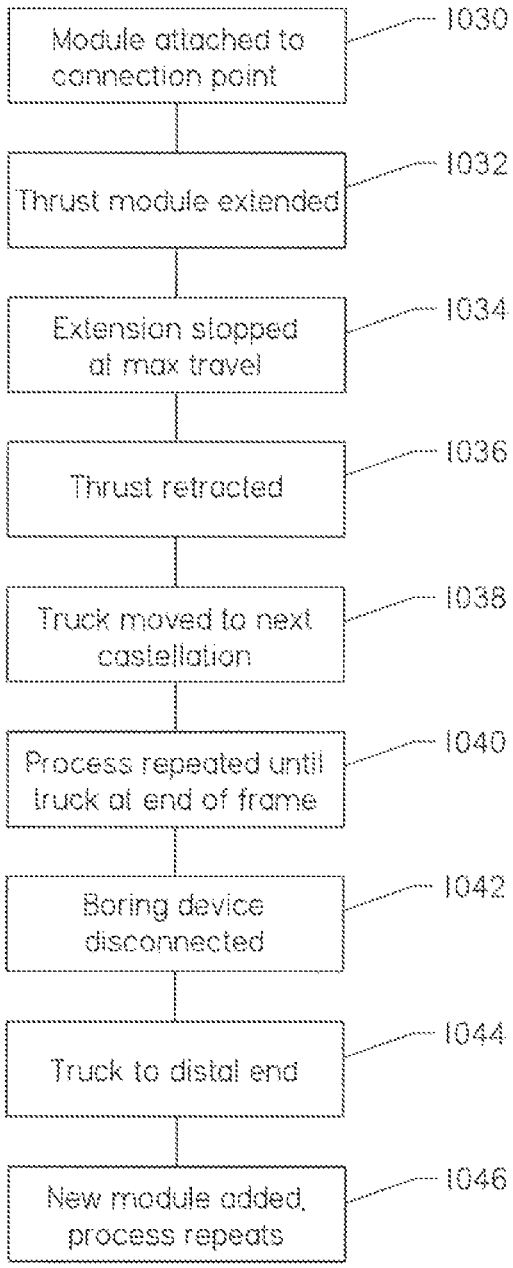
FIG. 13 is a flow chart illustrating a launch method for the boring device of the present invention.

With reference now to FIG. 13, the operational sequence of the launch platform 900 in the second mode is shown. The boring device 10, which includes a thrust module 500, is attached to the launch adaptor 925 of the carriage 906 at step 1030. The thrust module 500 (or modules, if more than one is included with boring device 10) is extended at step 1032, advancing the boring device into the subsurface 11. One will appreciate that in the second mode, the castellations 912 of the internal frame 904 act as a fixed reaction plate for the thrust operation. Full rotation may be optionally provided at step 1032 if generally straight travel is desired, while dithering or no rotation is utilized if steering is desired. At the end of its stroke, extension of the thrust module 500 is stopped at step 1034. The thrust module 500 is retracted at step 1036. During retraction, frictional forces between the subsurface 11 (FIG. 1) and boring tool 10 are greater than the force required to advance the carriage 906 along the rails 910. Therefore, retraction continues at step 1036 until the carriage 906 is moved to an adjacent castellation 912 at step 1038. Retraction of the thrust module 500 then stops and the process is repeated at step 1040 until the carriage reaches the last set of castellations 912. The boring device 10 is then disconnected from the module connection point 914 at step 1042, the carriage 906 is moved to a distal end of the internal frame 904 at step 1044, and a new module 300, 400, 500 is attached to the boring device 10 at step 1046. The entire process is then repeated to continue launching the boring device 10.

While launch module 900 enables launch of the boring device 10 at a surface of the ground or within a pit, other launch mechanisms are envisioned. For example, a conventional horizontal directional drill could be utilized to drill a pilot bore, and the boring device 10 placed within that pilot bore such that there are at least a rear anchor 300B, thrust module 500, and front anchor 300A in the ground. Then the conventional operation of the boring device 10 as illustrated in FIG. 8 may be utilized to advance the boring device.

One of ordinary skill in the art will appreciate that while the Figures show configurations for the subject invention, modifications to the particular shape and organization of the modular boring device 10 may be made without departing from the spirit of the disclosed invention.

What is claimed is:

1. A compaction boring device comprising:

a frame comprising a first end and a second end, wherein the first end is reciprocally moveable axially relative to the second end;

an extendable anchor supported within the frame extendable from a first position to a second position;

a boring head connected to the first end of the frame; and wherein the first end of the frame is rotatable relative to the second end to manipulate an orientation of the head.

2. The apparatus of claim 1 wherein the anchor secures a position of the second end relative to the subsurface when in the second position.

3. The apparatus of claim 2 comprising a second extendable anchor supported within the frame extendable from a first position to a second position, wherein the second extendable anchor secures a position of the first end relative to the subsurface when in the second position.

4. The apparatus of claim 1 wherein the frame further comprises a thrust module comprising:

a rod comprising a splined exterior;

a sleeve comprising a grooved interior, herein the grooved interior transmits torque to the splined exterior of the rod and the sleeve is movable axially relative to the rod; and a screw drive to move the rod relative to the sleeve.

5. The apparatus of claim 1 wherein the boring head comprises a slanted face.

6. The apparatus of claim 1 further comprising a cable having a first end and a second end, wherein the cable is attached at the first end to the second end of the frame and at the second end to a power source.

7. The apparatus of claim 1 further comprising a navigational sensor located on the frame, the navigational sensor comprising an orientation sensor and a magnetic field source.

8. An apparatus for boring through a subsurface comprising:

a modular compaction boring device comprising:

a boring head to compress the subsurface;

a first anchor;

a second anchor in which the boring head is rotatable relative to the second anchor and nonrotatable relative to the first anchor; and a thrust module comprising a thrust member disposed between the first anchor and the second anchor, and a first section and a second section, wherein the first section is moveable relative to the second section to push the head in response to operation of the thrust section.

9. The apparatus of claim 8 wherein the first anchor is supported on the first section.

10. The apparatus of claim 8 further comprising a rotation module to rotate the boring head relative to the second anchor.

11. The apparatus of claim 10 wherein the boring head comprises a steering geometry.

12. The apparatus of claim 11 wherein the steering geometry comprises a slanted face.

13. The apparatus of claim 11 wherein the modular compaction boring device further comprises an orientation sensor to detect a bearing of the boring head.

14. The apparatus of claim 10 wherein the rotation module is operable in a first direction and in a second direction.

15. The apparatus of claim 8 further comprising an umbilical cable comprising a first end and a second end, wherein the first end is connected to the modular compaction boring device.

16. The apparatus of claim 15 wherein the umbilical cable is connected to a controller at the second end.

17. The apparatus of claim 15 wherein the modular compaction boring device further comprises a magnetic field source proximate the boring head and an above ground receiver in communication with the controller, wherein the above ground receiver detects the magnetic field.

18. The apparatus of claim 8 wherein the thrust member comprises a screw drive, wherein operation of the screw drive in a first direction moves the first section of the thrust module away from the second section of the thrust module.

19. The apparatus of claim 8 wherein the first anchor comprises at least two extendable anchor arms movable between a first position and a second position.

20. The apparatus of claim 19 wherein the at least two extendable anchor arms are independently extendable.

21. The apparatus of claim 8 wherein the first anchor and second anchor exert a force on the subsurface having a component which is parallel to a length of the modular compaction boring device when the thrust module is not moving.

22. A method for advancing a tool through a subsurface comprising:

orienting a boring head by rotating a first end of the tool relative to a second end of the tool without thrust;

extending a first anchor;

longitudinally extending the tool;

extending a second anchor;

retracting the first anchor; and longitudinally retracting the tool.

23. The method of claim 22 wherein the tool is extended by a screw drive disposed between the first anchor and the second anchor.

24. The method of claim 23 wherein the second anchor is proximate the boring head.

25. The method of claim 22 further comprising providing a known steering geometry to the boring head.

26. The method of claim 25 further comprising steering the tool by extending the tool.

27. The method of claim 25 further comprising steering the tool straight by rotating the tool during thrust.

28. The method of claim 25 further comprising dithering the boring head.

29. The method of claim 22 further comprising:

transmitting a magnetic field from a magnetic field source proximate the boring head; and detecting a position of the magnetic field source from an above ground location.

30. The method of claim 22 further comprising detecting slip between the first anchor and the subsurface.

31. The method of claim 22 further comprising providing direct current power to extend the first anchor, extend the second anchor, extend the tool and retract the tool.

32. The method of claim 22 wherein extending the second anchor creates a footprint in the subsurface.

33. The method of claim 32 further comprising extending the first anchor into the footprint created by the second anchor.

34. An apparatus for boring through a subsurface comprising:

a modular compaction boring device comprising:

a forward anchor module comprising an extendable anchor arm;

an aft anchor module comprising an extendable anchor arm in which the forward anchor module is rotatable relative to the aft anchor module;

an extendable and retractable thrust module disposed between the forward anchor module and the aft anchor module; and a rotatable boring head disposed proximate the forward anchor module;

an electrical power source;

a controller for directing extension of the extendable anchor arm of the forward anchor module and the aft anchor module, directing extension and retraction of the thrust module, and rotation of the boring head; and an umbilical cable comprising a first end and a second end, wherein the umbilical cable provides power from the electrical power source to the modular compaction boring device.

35. The apparatus of claim 34 wherein the umbilical cable comprises a data communication cable disposed between the modular compaction boring device and the controller.

36. The apparatus of claim 34 wherein the rotatable boring head comprises a steering geometry.

37. The apparatus of claim 34 wherein the thrust module defines a stroke length, and wherein the extendable anchor arm of the forward anchor module and the extendable anchor arm of the aft anchor module are spaced apart at a multiple of the stroke length.

38. The apparatus of claim 34 further comprising a rotation module, wherein the rotation module causes relative rotation between the boring head and the aft anchor module.

39. The apparatus of claim 38 wherein the rotation module and thrust module are independently operable.

40. A compaction boring device comprising:

a frame comprising a first end and a second end, wherein the first end is reciprocally moveable axially relative to the second end, and wherein the frame defines a window;

an extendable anchor supported within the frame extendable from a first position to a second position wherein the extendable anchor is entirely disposed within the frame in the first position and protrudes from the window in the second position;

a boring head connected to the first end of the frame; and wherein the first end of the frame is rotatable relative to the second end to manipulate an orientation of the head.

41. A compaction boring device comprising:

a frame comprising a first end and a second end, wherein the first end is reciprocally moveable axially relative to the second end;

an extendable anchor supported within the frame extendable from a first position to a second position;

a boring head connected to the first end of the frame wherein the first end of the frame is rotatable relative to the second end to manipulate an orientation of the head; and a wedge and an anchor actuator, wherein the anchor actuator is disposed between the frame and the wedge and movable from a first position to a second position such that the wedge directly contacts the extendable anchor to extend the extendable anchor when in the second position.

42. An apparatus for boring through a subsurface comprising:

a modular compaction boring device comprising:

a forward anchor module comprising, an extendable anchor arm;

an aft anchor module comprising an extendable anchor arm;

an extendable and retractable thrust module disposed between the forward anchor module and the aft anchor module wherein the thrust module defines a stroke length, and wherein the extendable anchor arm of the forward anchor module and the extendable anchor arm of the aft anchor module are spaced apart at a multiple of the stroke length; and a rotatable boring head disposed proximate the forward anchor module;

an electrical power source;

a controller for directing extension of the extendable anchor arm of the forward anchor module and the aft anchor module, directing extension and retraction of the thrust module, and rotation of the boring head; and an umbilical cable comprising a first end and a second end, wherein the umbilical cable provides power from the electrical power source to the modular compaction boring device.

43. An apparatus for boring through a subsurface comprising:

a modular compaction boring device comprising:

a boring head to compress the subsurface;

a first anchor;

a second anchor; and a thrust module comprising a thrust member disposed between the first anchor and the second anchor, and a first section and a second section, wherein the first section is moveable relative to the second section to push the head in response to operation of the thrust section, and wherein the first anchor and second anchor exert a force on the subsurface having a component which is parallel to a length of the modular compaction boring device when the thrust module is not moving.

44. An apparatus for boring through a subsurface comprising:

a modular compaction boring device comprising:

a forward anchor module comprising an extendable anchor arm;

an aft anchor module comprising an extendable anchor arm;

an extendable and retractable thrust module disposed between the forward anchor module and the aft anchor module;

a rotatable boring head disposed proximate the forward anchor module; and a rotation module, wherein the rotation module causes relative rotation between the boring head and the aft anchor module, and wherein the rotation module and thrust module are independently operable;

an electrical power source;

a controller for directing extension of the extendable anchor arm of the forward anchor module and the aft anchor module, directing extension and retraction of the thrust module, and rotation of the boring head; and an umbilical cable comprising a first end and a second end, wherein the umbilical cable provides power from the electrical power source to the modular compaction boring device.

45. A compaction boring device comprising:

a frame comprising a first end and a second end, wherein the first end is reciprocally moveable axially relative to the second end;

an extendable anchor supported within the frame extendable from a first position to a second position;

a boring head connected to the first end of the frame, wherein the first end of the frame is rotatable relative to the second end to manipulate an orientation of the head; and a rotation module configured to cause rotation of the first end relative to the second end of the frame, wherein the rotation module and thrust module are independently operable.

* * * * *